United States Patent [19]

Naito et al.

[11] Patent Number: 4,474,867

[45] Date of Patent: Oct. 2, 1984

[54] HEAT-DEVELOPABLE COLOR PHOTOGRAPHIC MATERIAL

[75] Inventors: Hideki Naito; Hiroshi Hara; Toshiaki Aono; Kozo Sato, all of Kanagawa, Japan

[73] Assignee: Fuji Photo Film Co., Ltd., Kanagawa, Japan

[21] Appl. No.: 377,528

[22] Filed: May 12, 1982

[30] Foreign Application Priority Data

May 12, 1981 [JP] Japan ..... 56-71234

[51] Int. Cl.[3] ..... G03C 5/54; G03C 7/00; G03C 7/40

[52] U.S. Cl. ..... 430/203; 430/226; 430/543

[58] Field of Search ..... 430/203, 226, 543, 351, 430/619, 545, 617, 618

[56] References Cited

U.S. PATENT DOCUMENTS 3,531,286 9/1970 Renfrew ..... 430/351
3,761,270 9/1973 de Mauriac et al. ..... 430/351
4,021,240 5/1977 Cerquone et al. ..... 430/203
4,022,617 5/1977 McGuckin ..... 430/203

OTHER PUBLICATIONS

"Positive Images in Photothermographic Materials", Kohrt, *Research Disclosure,* No. 16408, 12/1977, pp. 15 & 16.

*Primary Examiner*—Richard L. Schilling
*Attorney, Agent, or Firm*—Sughrue, Mion, Zinn, Macpeak & Seas

[57] ABSTRACT

A diffusion transfer heat-developable color photographic material comprising a support having thereon a layer containing at least a light-sensitive silver halide, and the photographic material containing an organic silver salt oxidizing agent, a reducing agent, a hydrophobic binder and a dye releasing coupler which releases a diffusible dye upon heat development. The diffusion transfer heat-developable color photographic material can provide a stable color image by imagewise exposure to light and heat development procedure. A method of forming a color image using the diffusion transfer heat-developable color photographic material is also disclosed.

30 Claims, No Drawings

HEAT-DEVELOPABLE COLOR PHOTOGRAPHIC MATERIAL

FIELD OF THE INVENTION

The present invention relates to a heat-developable color photographic material which forms a color image by heat development. Particularly, the present invention relates to a novel heat-developable color photographic material containing a dye releasing coupler which releases a diffusible dye by heat development. In accordance with the present invention, a novel heat-developable color photographic material is utilized to obtain a color image by transferring the dye released by heat development.

BACKGROUND OF THE INVENTION

Photographic processes using silver halides have, in the past, been most widely used. They are used because of their excellent photographic properties such as sensitivity and gradation control as compared with other photographic processes, such as an electrophotographic process or a diazo photographic process. In recent years, substantial research has been done with respect to image formation processes for photographic materials using silver halide. As a result of this research many techniques capable of obtaining images with ease and rapidly have been developed by changing the conventional wet process using a developing solution into a dry process such as a process using heat.

Heat-developable photographic materials are known in the field of these techniques, and heat-developable photographic materials and processes therefor have been described in U.S. Pat. Nos. 3,152,904, 3,301,678, 3,392,020 and 3,475,075, British Pat. Nos. 1,131,108 and 1,167,777, and *Research Disclosure*, pp. 9–15, No. RD-17029, June, 1978.

Many different processes for obtaining color images have been proposed. With respecct to processes for forming color images by the reaction of an oxidation product of a developing agent with a coupler, it has been proposed to use a p-phenylenediamine type reducing agent and a phenolic coupler or an active methylene coupler as disclosed in U.S. Pat. No. 3,531,286, a p-aminophenol type reducing agent as disclosed in U.S. Pat. No. 3,761,270, a sulfonamidophenol type reducing agent as disclosed in Belgian Pat. No. 802,519 and *Research Disclosure*, pp. 31 and 32, September 1975. In addition, the combination of a sulfonamidophenol type reducing agent and a 4-equivalent coupler has been disclosed in U.S. Pat. No. 4,021,240. These processes, however, are disadvantageous in that turbid color images are formed due to the simultaneous formation of a reduced silver image and a color image on the exposed area after heat development. A proposed process for eliminating these disadvantages comprises removing silver images by liquid processing or transferring only the dyes to another layer, for example, a sheet having an image receiving layer. However, it is not easy to transfer only the dyes as distinguishable from unreacted substances.

A process which comprises introducing a nitrogen containing heterocyclic group into a dye, forming a silver salt and releasing a dye by heat development has been described in *Research Disclosure*, pp. 54–58, No. RD-16966, May, 1978. According to this process, clear images cannot be obtained, because it is difficult to control the release of dyes from unexposed areas. Therefore, it is not a conventional process.

Furthermore, with respect to a process for forming a positive color image by a thermal silver dye bleach process, useful dyes and methods for bleaching have been described, for example, in *Research Disclosure*, pp. 30–32, No. RD-14433, April, 1976, ibid., pp. 14–15, No. RD-15227, December, 1976, U.S. Pat. No. 4,235,957, etc.

However, this process requires an additional step and an additional material for accelerating bleaching of dyes, for example, heating with a superimposed activating agent sheet. Furthermore, it has a drawback that the resulting color images are gradually reduced and bleached by coexisting free silver during preservation for a long time.

A process for forming a color image utilizing a leuco dye has been described, for example, in U.S. Pat. Nos. 3,985,565 and 4,022,617. However, with this process it is difficult to stably incorporate the leuco dyes in the photographic material and coloration gradually occurs during preservation.

SUMMARY OF THE INVENTION

The present invention provides a novel process for forming a color image using a heat-developable color photographic material eliminating the drawbacks of known materials.

Therefore, an object of the present invention is to provide a novel dye releasing coupler for a heat-developable color photographic material.

Another object of the present invention is to provide a process for easily forming a color image using a novel dye releasing coupler.

Still another object of the present invention is to provide a process for obtaining a clear color image by a simple procedure.

Further object of the present invention is to provide a process for obtaining a color image which is stable for a long period of time.

These and other objects of the present invention will become more apparent from the following detailed description and examples.

These objects of the present invention are accomplished with a diffusion transfer heat-developable color photographic material comprising a support having thereon a layer containing at least a light-sensitive silver halide, and the photographic material containing an organic silver salt oxidizing agent, a reducing agent, a hydrophobic binder and a dye releasing coupler which releases a diffusible dye upon heat development.

DETAILED DESCRIPTION OF THE INVENTION

The heat-developable color photographic material of the present invention can simultaneously provide a silver image having a negative-positive relationship to the original and a diffusible dye on the part corresponding to the silver image by only carrying out heat development after imagewise exposure to light. That is, when the heat-developable color photographic material of the present invention is imagewise exposed to light and developed by heating, an oxidation-reduction reaction occurs between an organic silver salt oxidizing agent and a reducing agent by means of exposed light-sensitive silver halide as a catalyst to form a silver image in the exposed area, or an oxidation-reduction reaction occurs between an exposed light-sensitive silver halide and a reducing agent in the presence of an organic silver salt oxidizing agent to form a silver image in the exposed area. In this step, the reducing agent is oxidized by the organic silver salt oxidizing agent to form an oxidized product. This oxidized product causes a coupling reaction with a dye releasing coupler capable of releasing a diffusible dye which is incorporated into the photographic material and consequently the diffusible dye is released. Accordingly, the silver image and the diffusible dye are formed in the exposed area, and a color image is obtained by transferring the diffusible dye.

The light-sensitive silver halide used in the present invention can be employed in a range from 0.005 mol to 5 mols and, preferably, from 0.005 mol to 1.0 mol per mol of the organic silver salt oxidizing agent.

Examples of silver halide include silver chloride, silver chlorobromide, silver chloroiodide, silver bromide, silver iodobromide, silver chloroiodobromide and silver iodide.

The particle size of the silver halide used is from 0.001 μm to 2 μm and, preferably from 0.001 μm to 1 μm.

The silver halide used in the present invention may be employed as is, but it may be chemically sensitized with a chemical sensitizing agent such as a compound containing sulfur, selenium or tellurium, etc., or a compound containing gold, platinum, palladium, rhodium or iridium, etc., a reducing agent such as a tin halide, etc., or a combination thereof.

The details of these procedures are described in T. H. James, *The Theory of the Photographic Process*, Fourth Edition, Chapter 5, pp. 149–169.

The organic silver salt oxidizing agent which can be used in the present invention is a silver salt which is comparatively stable to light and which forms a silver (image) by reacting with the above-described image forming substance or a reducing agent which is coexisting with the image forming substance, if desired, when it is heated to a temperature of above 80° C. and, preferably, above 100° C. in the presence of exposed silver halide.

Examples of such organic silver salt oxidizing agents include the following compounds.

A silver salt of an organic compound having a carboxy group. Typical examples thereof include a silver salt of an aliphatic carboxylic acid and a silver salt of an aromatic carboxylic acid.

Examples of the silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linolate, silver oleate, silver adipate, silver sebacate, silver succinate, silver acetate, silver butyrate and silver camphorate, etc. These silver salts which are substituted with a halogen atom or a hydroxyl group are also effectively used.

Examples of the silver salts of aromatic carboxylic acids and other carboxyl group-containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione or the like as described in U.S. Pat. No. 3,785,830, and a silver salt of an aliphatic carboxylic acid containing a thioether group as described in U.S. Pat. No. 3,330,663, etc.

In addition, a silver salt of a compound containing a mercapto group or a thione group and a derivative thereof can be used.

Examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-mercaptobenzothiazole, a silver salt of 2-(s-ethylglycolamido)benzothiazole, a silver salt of thioglycolic acid such as a silver salt of an s-alkyl thioglycolic acid (wherein the alkyl group has from 12 to 22 carbon atoms) as described in Japanese Patent Application (OPI) No. 28221/73 (the term "OPI" as used herein refers to a "published unexamined Japanese patent application"), a silver salt of dithiocarboxylic acid such as a silver salt of dithioacetic acid, a silver salt of thioamide, a silver salt of 5-carboxyl-1-methyl-2-phenyl-4-thiopyridine, a silver salt of mercaptotriazine, a silver salt of 2-mercaptobenzoxazole, a silver salt of mercaptooxadiazole, a silver salt as described in U.S. Pat. No. 4,123,274, for example, a silver salt of 1,2,4-mercaptotriazole derivative such as a silver salt of 3-amino-5-benzylthio-1,2,4-triazole, a silver salt of thione compound such as a silver salt of 3-(2-carboxyethyl)-4-methyl-4-thiazoline-2-thione as described in U.S. Pat. No. 3,301,678, and the like.

Furthermore, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure*, Vol. 170, No. 17029, June, 1978 and an organic metal salt such as copper stearate, etc., are examples of the organic metal salt oxidizing agent capable of being used in the present invention.

The mechanism of the heat development process under heating, in the present invention, is not entirely clear. However, it is believed to be as follows.

When the photographic material is exposed to light, a latent image is formed in a light-sensitive silver halide. This phenomenon is described in T. H. James, *The Theory of the Photographic Process*, Third Edition, pp. 105–148.

The silver halide and the organic silver salt oxidizing agent which form a starting point of development should be present within a substantially effective distance.

For this purpose, it is desired that the silver halide and the organic silver salt oxidizing agent are present in the same layer.

The silver halide and the organic metal salt oxidizing agent which are separately formed in a hydrophobic binder can be mixed prior to use to prepare a coating solution. However, it is also effective to blend both of them in a ball mill for a long period of time. Further, it is effective to use a process which comprises adding a halogen-containing compound to the organic silver salt oxidizing agent prepared to form silver halide using silver of the organic silver salt oxidizing agent.

Methods of preparing these silver halide and organic silver salt oxidizing agent and manners of blending them are described in *Research Disclosure*, No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total from 50 mg to 10 g/m$^2$ calculated as an amount of silver.

The dye releasing coupler which releases a diffusible dye which can be used in the present invention is represented by the following general formula:

C—L—D wherein C represents a coupler capable of bonding to an oxidized product which is formed by a reaction between a reducing agent and an organic silver salt oxidizing agent or an exposed silver halide; D represents a dye portion for forming an image; and L represents a connecting group between C and D and the bond between C and L is cleaved upon the reaction of C with the oxidized product of the reducing agent.

The coupler represented by C, being capable of bonding to an oxidized product which is formed by a reaction between a reducing agent and an organic silver salt oxidizing agent, includes an active methylene residue, an active methine residue, a phenol residue, a naphthol residue, etc. Preferred examples of the couplers are represented by the following general formulae (I) to (VII):

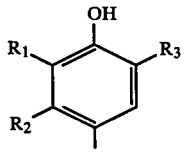
(I)

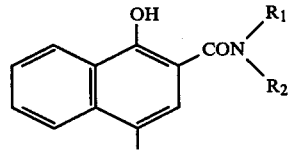
(II)

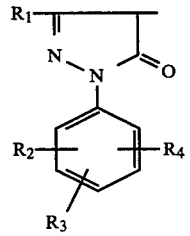
(III)

$R_1COCHCOR_2$
|
(IV)

-continued

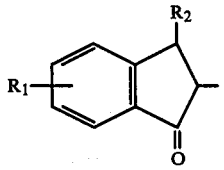
(V)

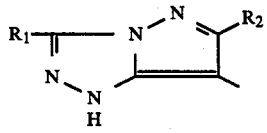
(VI)

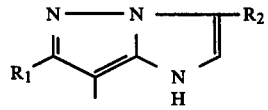
(VII)

wherein $R_1$, $R_2$, $R_3$ and $R_4$, which may be the same or different, each represents a hydrogen atom or a substitutent selected from the group consisting of an alkyl group, a cycloalkyl group, an aryl group, an alkoxy group, an aryloxy group, an aralkyl group, an acyl group, an acylamino group, an alkoxyalkyl group, an aryloxyalkyl group, an N-substituted carbamoyl group, an alkylamino group, an arylamino group, a halogen atom, an acyloxy group, an acyloxyalkyl group and a cyano group, and these substitutents may be further substituted with a hydroxyl group, a carboxyl group, a sulfo group, a cyano group, a nitro group, a sulfamoyl group, an N-substituted sulfamoyl group, a carbamoyl group, an N-substituted carbamoyl group, an acylamino group, an alkylsulfonylamino group, an arylsulfonylamino group, an alkyl group, an aryl group, an alkoxy group, an aryloxy group, an aralkyl group or an acyl group.

Particularly preferred couplers are those immobilized in a hydrophobic polymer binder, for example, those having a hydrophilic group such as a sulfo group or a salt thereof, a carboxylic acid or a salt thereof, a phosphoric acid group or a salt thereof, a carbonamido group, a sulfonamido group or a hydroxy group, etc.

Preferred examples of the couplers C are set forth below, but the present invention is not to be construed as being limited thereto.

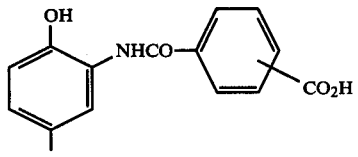
(C-1)

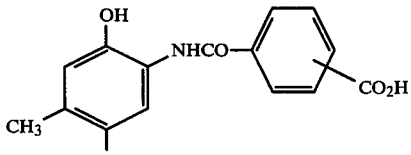
(C-2)

-continued
(C-3)
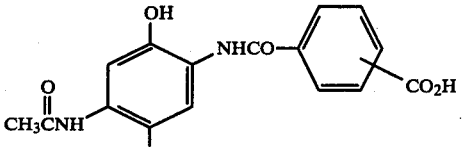
(C-4)
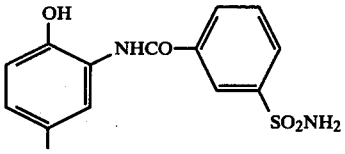
(C-5)
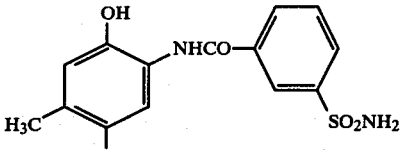
(C-6)
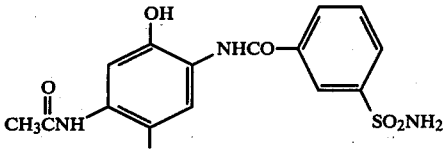
(C-7)
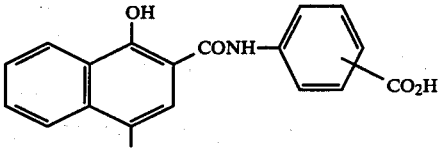
(C-8)
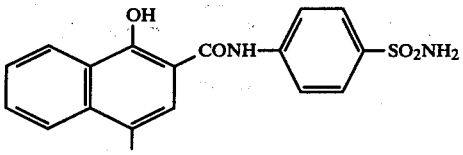
(C-9)
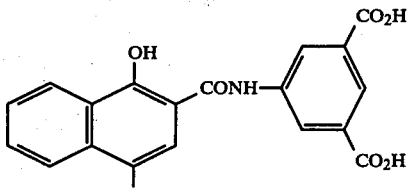
(C-10)
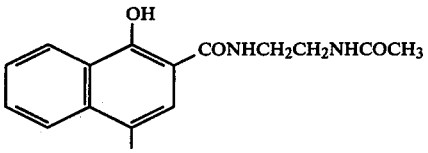
(C-11)
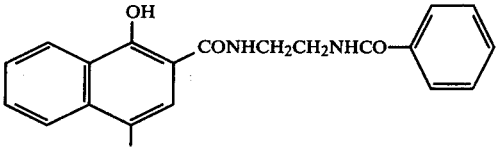
-continued
(C-12)
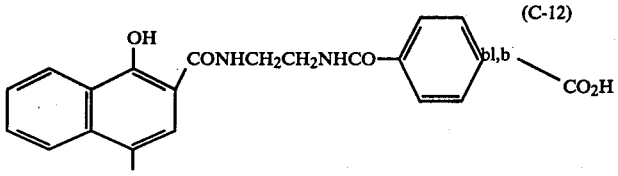
(C-13)
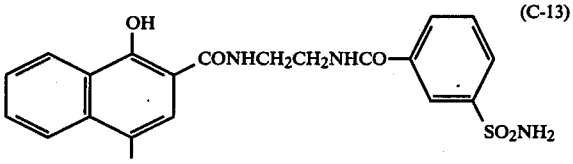
(C-14)
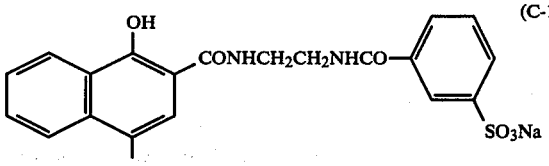
(C-15)
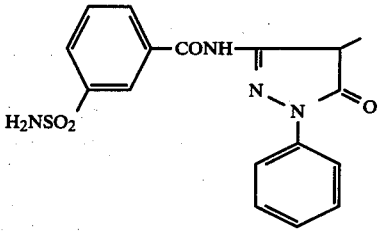
(C-16)
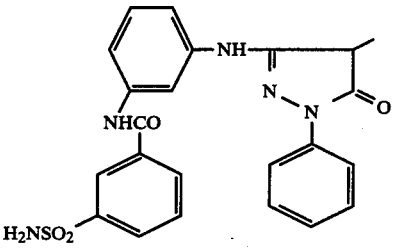
(C-17)
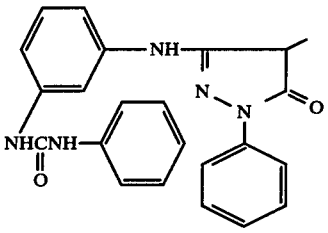
(C-18)
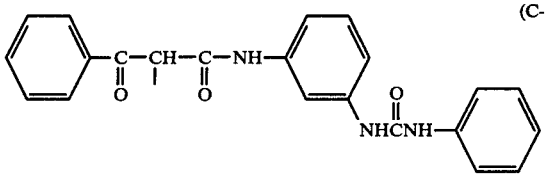

-continued (C-19)

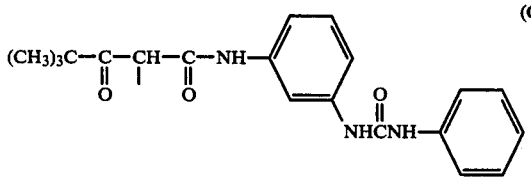

(C-20)

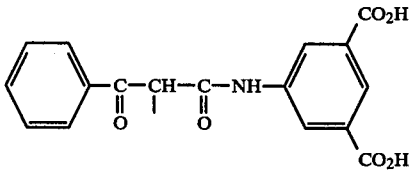

(C-21)

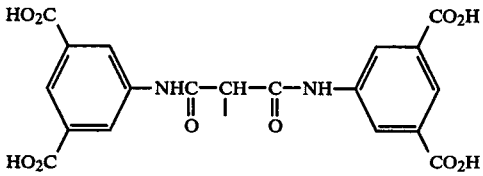

(C-22)

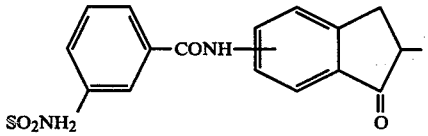

The connecting group L is a group connecting between the coupler C and the dye portion D with a covalent bond and it also acts as a releasable group in the reaction of the oxidized product of the reducing agent with the coupler C.

Preferred connecting groups L are represented by the following general formula (VIII):

$$-A-X-B- \qquad \text{(VIII)}$$

wherein A and B, which may be the same or different, each represents an oxygen atom, a sulfur atom, a CO group, an SO group, an $SO_2$ group, or an NR group where R is a hydrogen atom or an alkyl group; and X represents an organic group having a total carbon atom including A and B of not more than 12.

Preferred examples of the connecting group L include a divalent residue selected from the group represented by the following formulae:

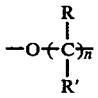

n = 0–3

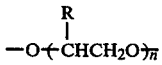

n = 1–2

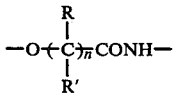

n = 0–3

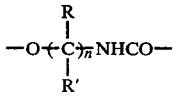

n = 1–3

-continued

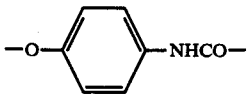

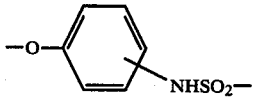

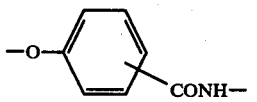

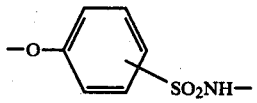

—NHCONH—

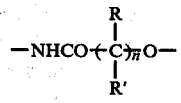

n = 0–3

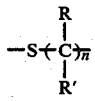

n = 0–3

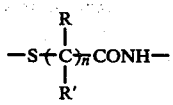

n = 1–3

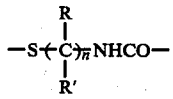

n = 1–3

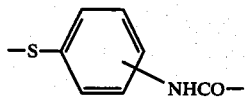

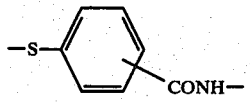

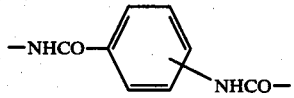

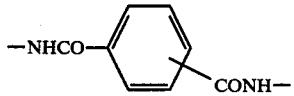

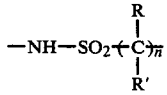

n = 0–3

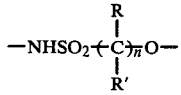

n = 1–4

-continued

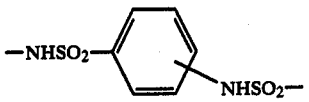

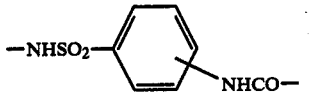

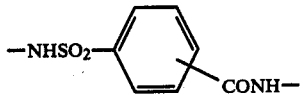

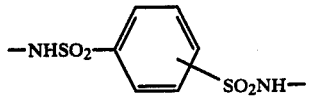

In the above formulae, R and R′, which may be the same or different, each represents a hydrogen atom, a methyl group or an ethyl group, and the benzene ring may further be substituted with an alkyl group, an alkoxy group or a halogen atom.

Preferred connecting groups for L are an O-releasing type group or an S-releasing type group. Groups containing a total of not more than 12 carbon atoms and having the structure shown below are particularly preferred. However, the present invention is not to be construed as being limited thereto.

$-O-CH_2CH_2-$ (L-1)

$-O-CH_2CH_2CH_2-$ (L-2)

$-O-CH_2CONH-$ (L-3)

$-O-CH_2CH_2CONH-$ (L-4)

$-O-\overset{CH_3}{\overset{|}{CH}}-$ (L-5)

$-O-\overset{CH_3}{\overset{|}{CH}}-CH_2-$ (L-6)

$-O-CH_2\overset{CH_3}{\overset{|}{CH}}-$ (L-7)

$-O-CH_2CH_2O-$ (L-8)

$-O-\overset{CH_3}{\overset{|}{CH}}CH_2O-$ (L-9)

$-O-\overset{CH_3}{\overset{|}{CH}}-CONH-$ (L-10)

$-O-\overset{CH_3}{\overset{|}{\underset{CH_3}{\underset{|}{C}}}}-CONH-$ (L-11)

$-OCH_2CH_2NHCO-$ (L-12)

$-O-CH_2CH_2CH_2NHCO-$ (L-13)

-continued

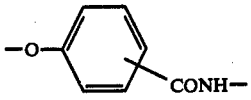

(L-14)

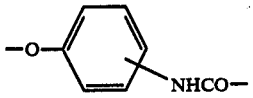

(L-15)

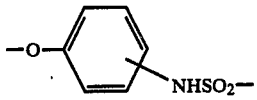

(L-16)

$-S-$ (L-17)

$-SCH_2CONH-$ (L-18)

$-SCH_2CH_2NHCO-$ (L-19)

$-SCH_2CH_2NHSO_2-$ (L-20)

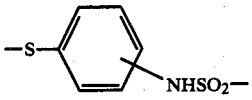

(L-21)

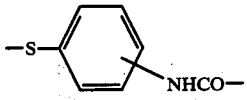

(L-22)

The dye D in the dye releasing coupler includes an azo dye, an azomethine dye, an anthraquinone dye, a naphthoquinone dye, a nitro dye, a styryl dye, a quinophthalone dye, a triphenylmethane dye and a phthalocyanine dye. Typical examples of the dyes are set forth below and are classified by hue.

Yellow:

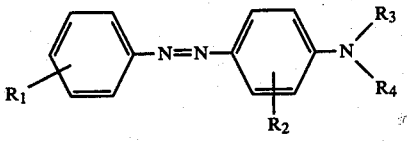

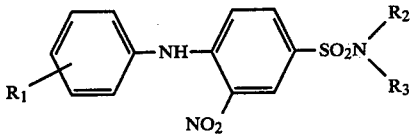

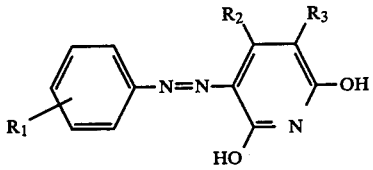

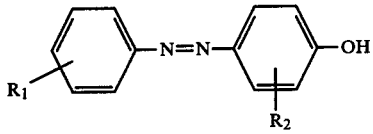

-continued
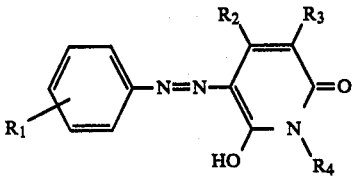
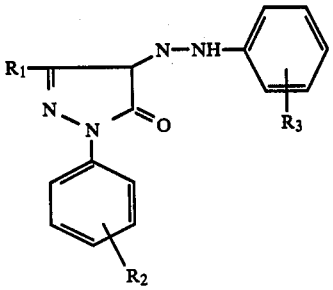
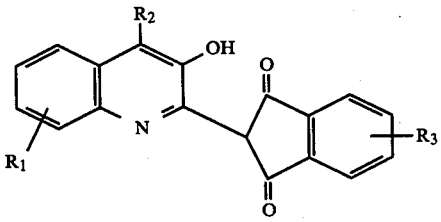
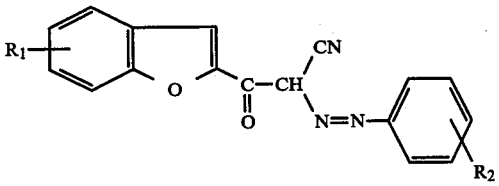
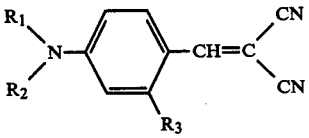
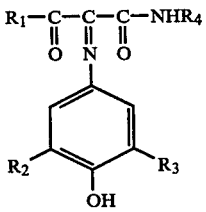
Magenta:
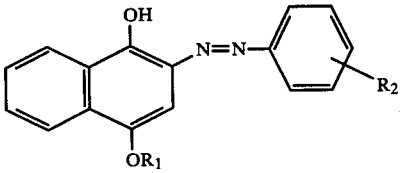
-continued
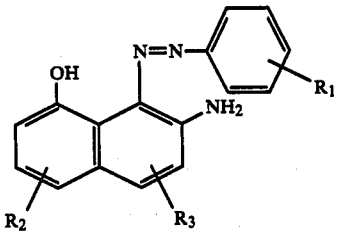
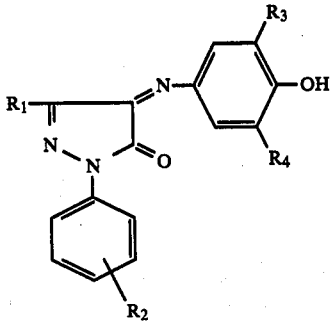
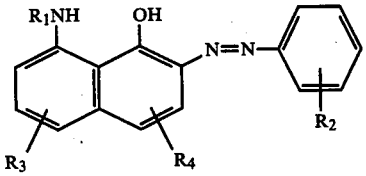
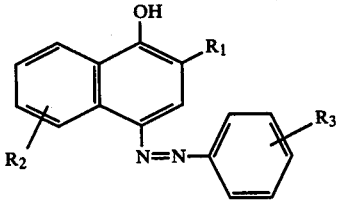
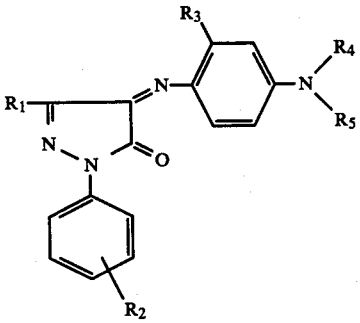
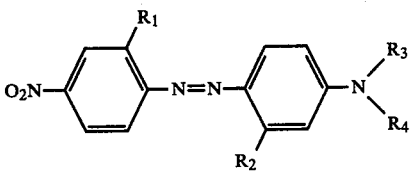
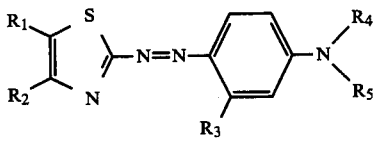

-continued
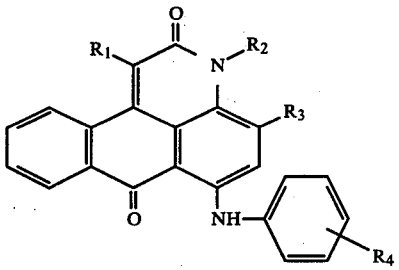
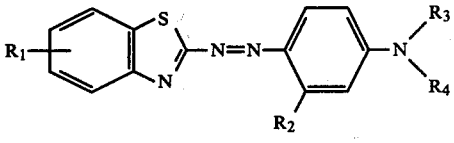
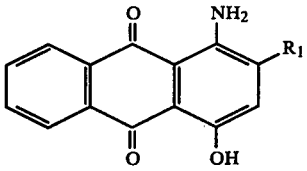
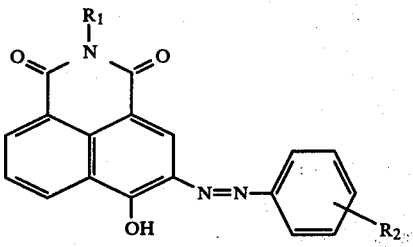
Cyan:
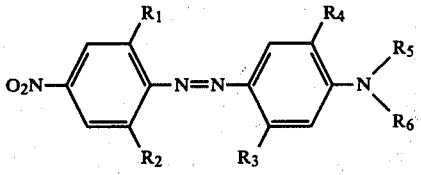
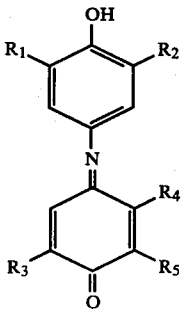
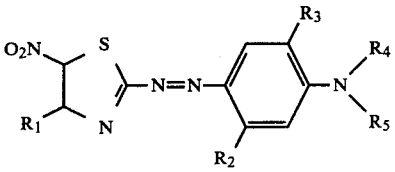
-continued
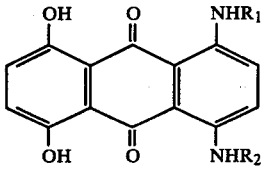
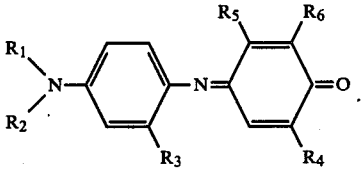
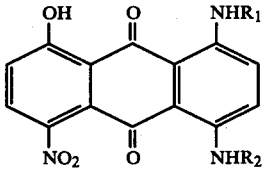
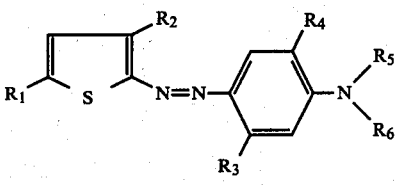
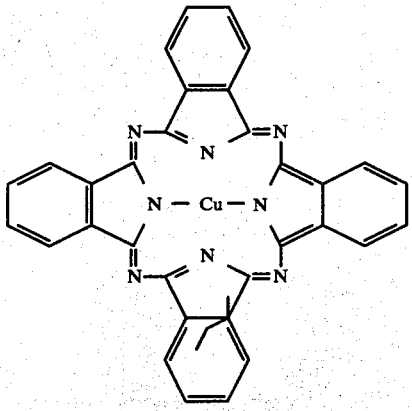
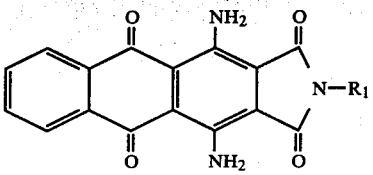
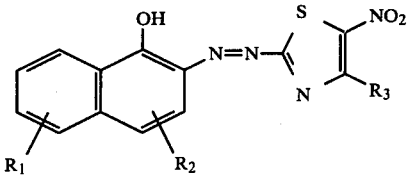

-continued

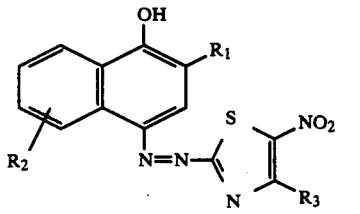

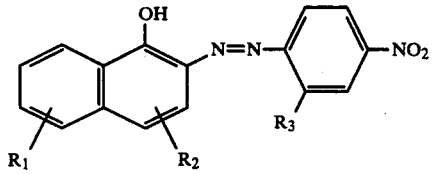

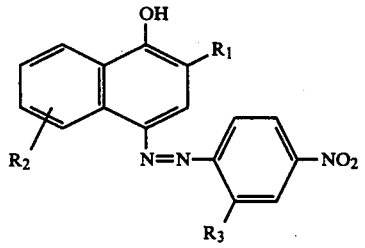

In the above formulae, $R_1$ to $R_6$, which may be the same or different, each represents a hydrogen atom or a substituent selected from the group consisting of an alkyl group, a cycloalkyl group, an aralkyl group, an alkoxy group, an aryloxy group, an aryl group, an acylamino group, an acyl group, a cyano group, a hydroxy group, an alkylsulfonylamino group, an arylsulfonylamino group, an alkylsulfonyl group, a hydroxyalkyl group, a cyanoalkyl group, an alkoxycarbonylalkyl group, an alkoxyalkyl group, an aryloxyalkyl group, a nitro group, a halogen, a sulfamoyl group, an N-substituted sulfamoyl group, a carbamoyl group, an N-substituted carbamoyl group, an acyloxyalkyl group, an amino group, a substituted amino group, an alkylthio group and an arylthio group.

Characteristics required for the image forming dyes are: (1) it does not have a carboxylic acid group or a sulfonic acid group and has excellent heat diffusibility in the hydrophobic polymer, and thus can effectively diffuse into an image receiving layer; (2) it has a good hue; (3) it has a large molecular extinction coefficient; (4) it is stable to light, heat and a nucleophilic reagent; and (5) it is easily synthesized.

Preferred examples of the image forming dyes which satisfy the above described requirements are set forth below, but the present invention is not to be construed as being limited thereto.

Yellow:

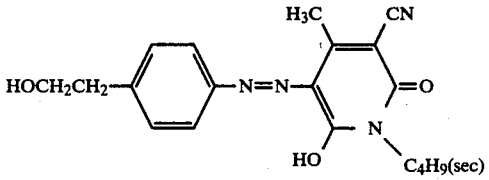

-continued

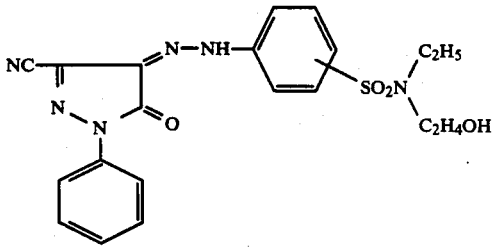

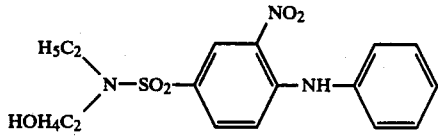

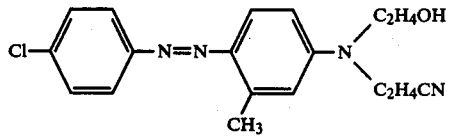

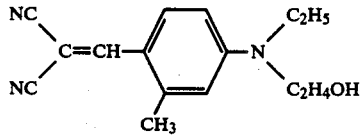

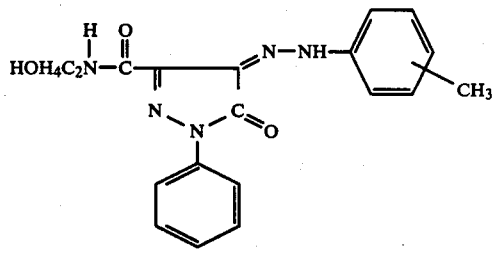

Magenta:

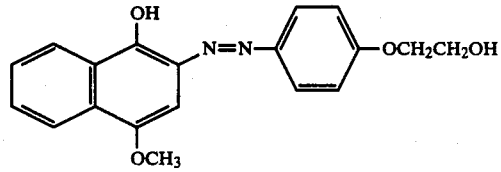

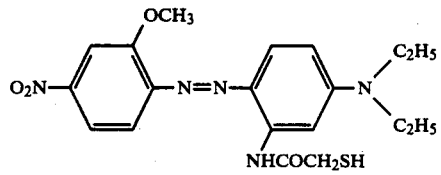

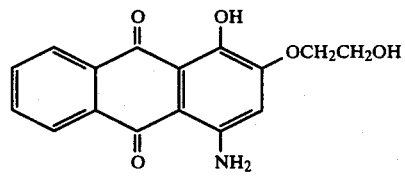

-continued

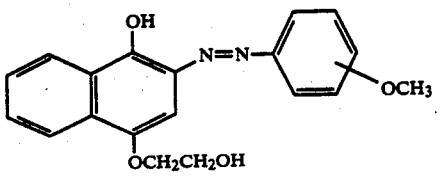

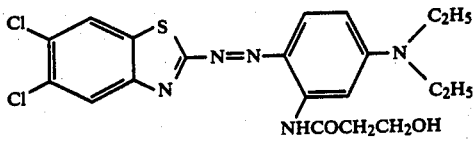

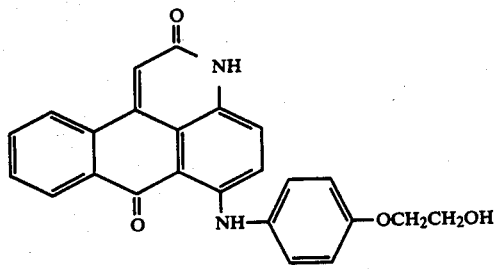

Cyan:

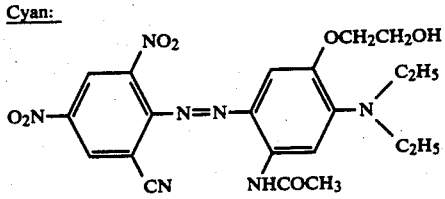

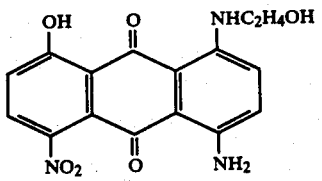

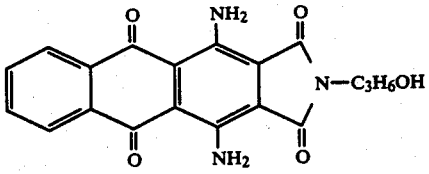

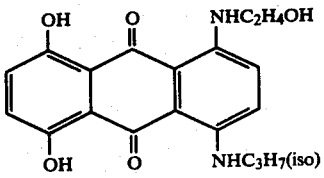

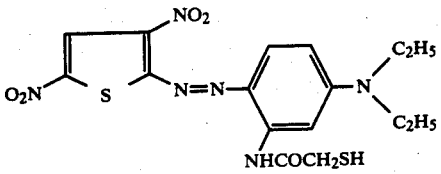

-continued

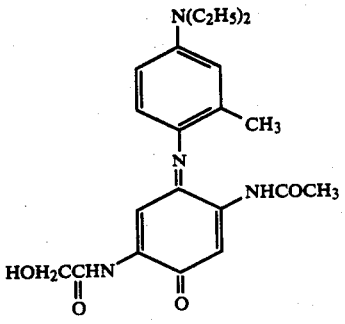

As the dye, a precursor thereof may also be employed.

Preferred dye releasing couplers capable of releasing a diffusible dye are those immobilized in a hydrophobic polymer binder and only a dye released therefrom upon the reaction is diffusible. Therefore, dye releasing couplers in which the coupler C has a hydrophilic group whereby the dye releasing couplers are immobilized in a hydrophobic polymer binder and the dye portion D does not contain a hydrophilic group such as a carboxy group, a sulfo group, etc., and is oil-soluble are preferred.

Preferred examples of the dye releasing couplers are set forth below, but the present invention is not to be construed as being limited thereto.

[1]

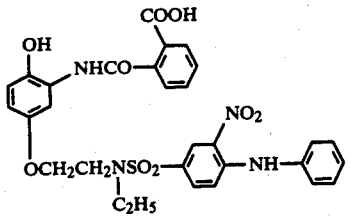

[2]

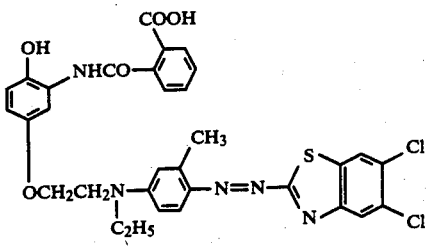

[3]

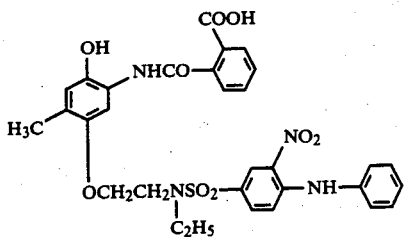

-continued
[4]
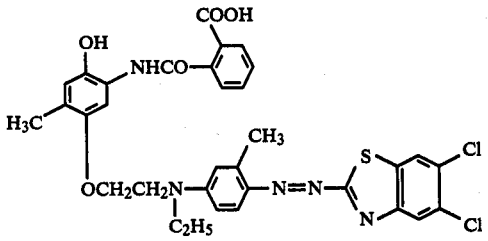
[5]
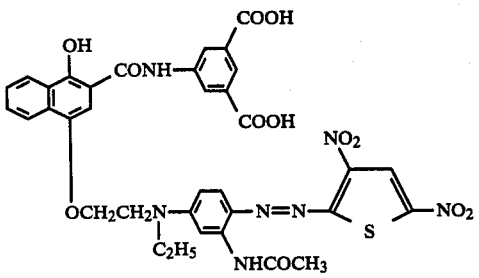
[6]
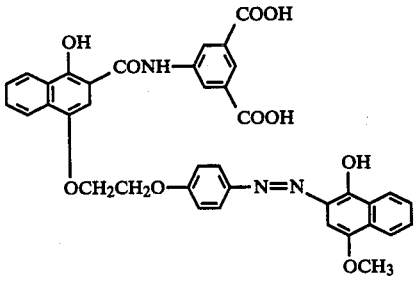
[7]
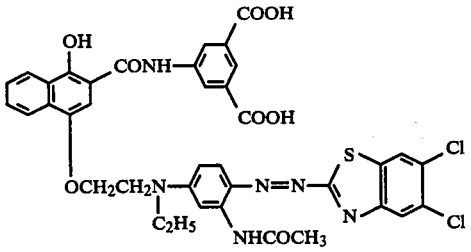
[8]
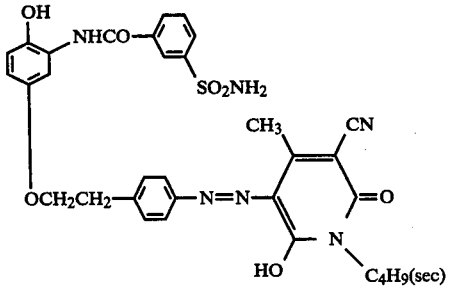
[9]
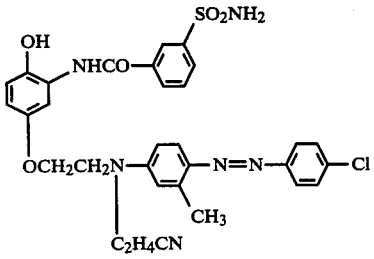
-continued
[10]
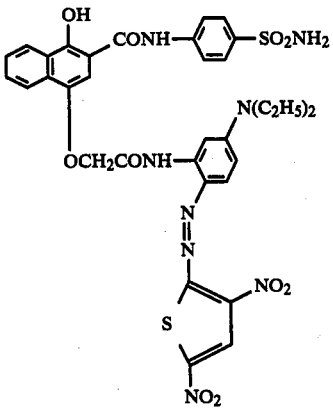
[11]
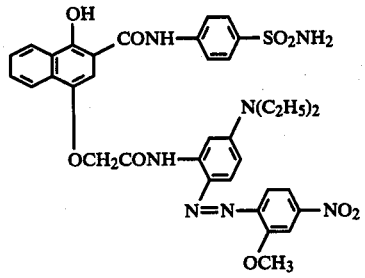
[12]
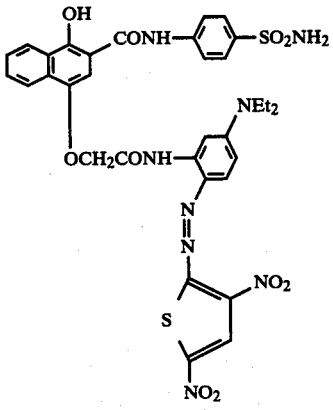
[13]
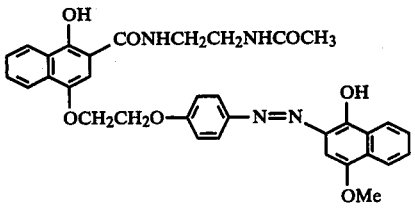
[14]
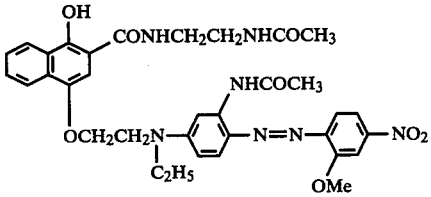

-continued
[15]
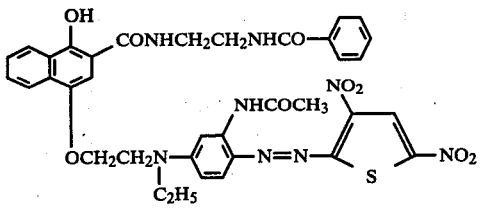
[16]
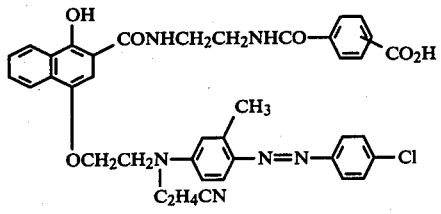
[17]
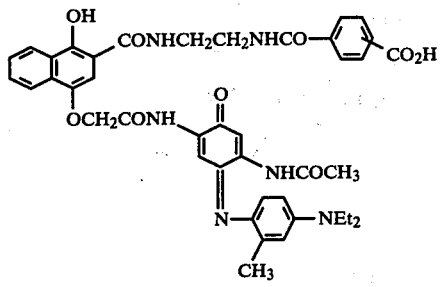
[18]
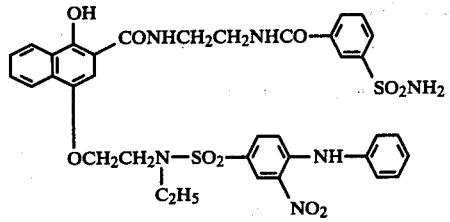
[19]
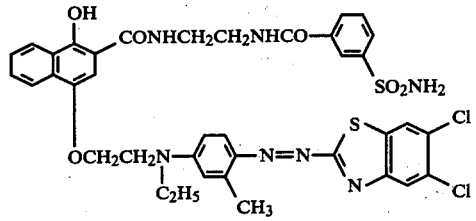
[20]
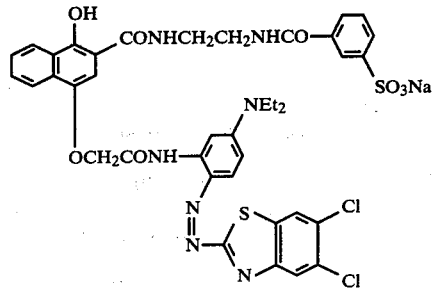
-continued
[21]
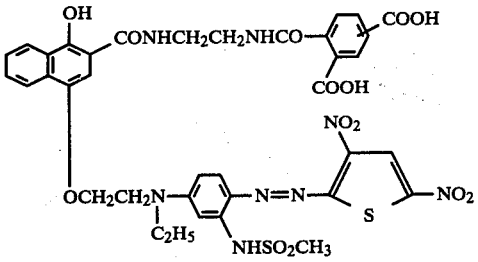
[22]
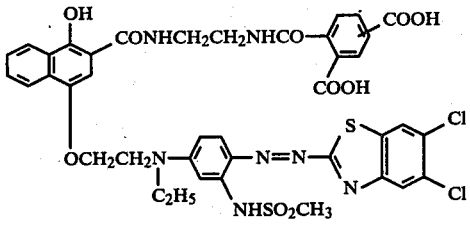
[23]
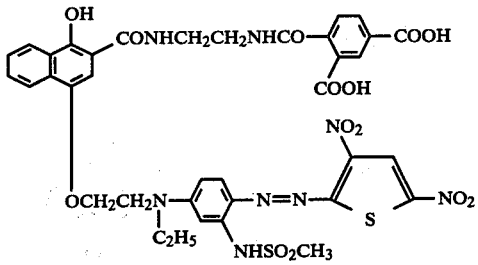
[24]
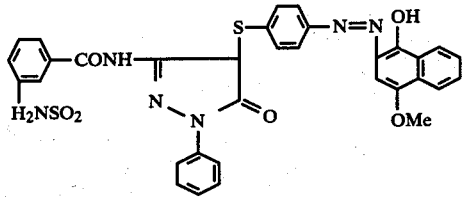
[25]
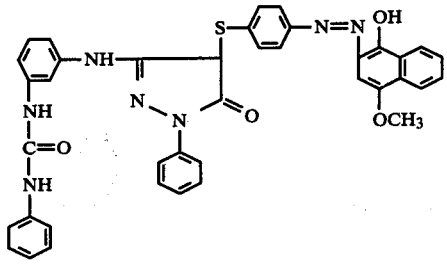
[26]
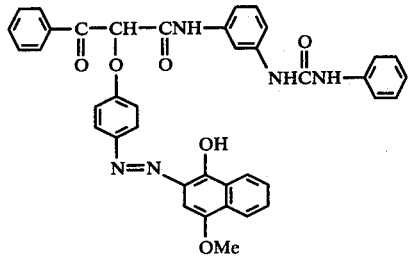

-continued

[27]

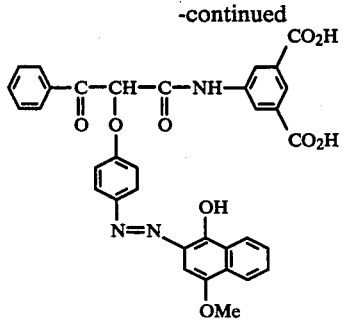

The reducing agent which can be used in the present invention is oxidized by the organic silver salt oxidizing agent to form an oxidized product capable of reacting with the dye releasing coupler and releasing a dye to form a color image. An example of a useful effective reducing agent having such an ability is a color developing agent capable of forming an image upon oxidative coupling. Examples of reducing agents used in the heat-developable color photographic material of the present invention include p-phenylenediamine type color developing agents including N,N-diethyl-3-methyl-p-phenylenediamine which is a typical example described in U.S. Pat. No. 3,531,286. An example of an effective reducing agent is an aminophenol which is described in U.S. Pat. No. 3,761,270. Of the aminophenol type reducing agents, 4-amino-2,6-dichlorophenol, 4-amino-2,6-dibromophenol, 4-amino-2-methylphenol sulfate, 4-amino-3-methylphenol sulfate, 4-amino-2,6-dichlorophenol hydrochloride, etc., are particularly useful. Further, a 2,6-dichloro-4-substituted sulfonamidophenol, and a 2,6-dibromo-4-substituted sulfonamidophenol, etc., described in *Research Disclosure,* Vol. 151, No. 15108 and U.S. Pat. No. 4,021,240 are also useful. In addition to the phenol type reducing agents described above, a naphthol type reducing agent, for example, a 4-aminonaphthol derivative and a 4-substituted sulfonamidonaphthol derivative is useful. Moreover, a generally applicable color developing agent, an aminohydroxy pyrazole derivative as described in U.S. Pat. No. 2,895,825, an aminopyrazoline derivative as described in U.S. Pat. No. 2,892,714, a hydrazone derivative as described in *Research Disclosure,* pp. 227–230 and 236–240, Nos. RD-19412 and RD-19415, June, 1980 may also be used. These reducing agents can be used individually or in combination.

In addition to the above-described reducing agent, a reducing agent described below may be used as an auxiliary developing agent. Examples of useful auxiliary developing agents include hydroquinone, an alkyl substituted hydroquinone such as tertiary butylhydroquinone or 2,5-dimethylhydroquinone, etc., a catechol, a pyrogallol, a halogen substituted hydroquinone such as chlorohydroquinone or dichlorohydroquinone, etc., an alkoxy substituted hydroquinone such as methoxyhydroquinone, etc., and a polyhydroxybenzene derivative such as methyl hydroxynapthalene, etc. Further, methyl gallate, ascorbic acid, an ascorbic acid derivative, a hydroxylamine such as N,N'-di(2-ethoxyethyl)-hydroxylamine, etc., a pyrazolidone such as 1-phenyl-3-pyrazolidone or 4-methyl-4-hydroxymethyl-1-phenyl-3-pyrazolidone, etc., a reductone and hydroxy tetronic acid are also useful.

The reducing agent can be used in a certain range of concentration. In general, a suitable concentration range of the reducing agent is from about 0.1 mol to about 4 mols of the reducing agent per mol of the oxidizing agent. A suitable concentration of the reducing agent used in the present invention is generally from about 0.1 mol to about 20 mols of the reducing agent per mol of the oxidizing agent.

In the heat-developable color photographic material of the present invention, various kinds of bases and base releasing agents can be employed. By using the base or base releasing agent, a desirable color image can be obtained at a lower temperature.

Examples of preferred bases are amines which include a trialkylamine, a hydroxyalkylamine, an aliphatic polyamine, an N-alkyl substituted aromatic amine, an N-hydroxyalkyl substituted aromatic amine and a bis[p-(dialkylamino)phenyl]methane. Further, betaine tetramethylammonium iodide and diaminobutane dihydrochloride as described in U.S. Pat. No. 2,410,644, and urea and an organic compound including an amino acid such as 6-aminocaproic acid as described in U.S. Pat. No. 3,506,444 are useful. The base releasing agent is a compound or a mixture which releases a basic component by heating, and the basic component is capable of activating the photographic material. Examples of typical base releasing agents are described in British Pat. No. 998,949. Preferred base releasing agents include a salt of a carboxylic acid and an organic base, and examples of suitable carboxylic acids include trichloroacetic acid and trifluoroacetic acid, etc., and examples of the suitable bases include guanidine, piperidine, morpholine, p-toluidine and 2-picoline, etc. Guanidine trichloroacetate as described in U.S. Pat. No. 3,220,846 is particularly preferred. Further, an aldonic amide as described in Japanese Patent Application (OPI) No. 22625/75 are preferably used because it decomposes at high temperature to form a base.

Further, in the heat-developable color photographic material of the present invention, many known silver salt stabilizing compounds which activate development and simultaneously stabilize the silver salt can be effectively used. Of these compounds, an isothiuronium including 2-hydroxyethylisothiuronium trichloroacetate as described in U.S. Pat. No. 3,301,678, a bisisothiuronium including 1,8-(3,6-dioxaoctane)-bis-(isothiuronium trifluoroacetate), etc., as described in U.S. Pat. No. 3,669,670, a thiol compound as described in West German Patent Application (OLS) No. 2,162,714, a thiazolium compound such as 2-amino-2-thiazolium trichloroacetate, 2-amino-5-bromoethyl-2-thiazolium trichloroacetate, etc., as described in U.S. Pat. No. 4,012,260, a compound having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, a compound having 2-carboxycarboxyamide as an acid part as described in U.S. Pat. No. 4,088,496, and the like are preferably employed.

These compounds or mixtures thereof can be used in a wide range of amounts. It is preferable to use them in the range of from 1/100 to 10 times and, more preferably, from 1/20 to 2 times by molar ratio based on silver.

A thermal solvent can be incorporated in the heat-developable color photographic material of the present invention. The term "thermal solvent" means a non-hydrolyzable organic material which is solid at an ambient temperature but melts together with other components at the temperature of heat treatment or a temperature lower than the heat treatment temperature. Examples of useful thermal solvents are compounds which dissolve the developing agent and have a high dielectric constant which accelerates physical development of the silver salt. Preferred examples of the thermal solvents include a polyglycol as described in U.S. Pat. No. 3,347,675, for example, polyethylene glycol having an average molecular weight of 1,500 to 20,000, a derivative of polyethylene oxide such as an oleic acid ester thereof, etc., beeswax, monostearin, a compound having a high dielectric constant which has an —$SO_2$— or —CO— group such as acetamide, succinimide, ethylcarbamate, urea, methylsulfonamide, ethylene carbonate, etc., a polar substance as described in U.S. Pat. No. 3,667,959, lactone of 4-hydroxybutanoic aicd, methylsulfinylmethane, tetrahydrothiophene-1, 1-dioxide, 1,10-decanediol, methyl anisate, biphenyl suberate, etc., as described in *Research Disclosure,* pp. 26–28, Dec., 1976, etc.

The silver halide and the organic silver salt oxidizing agent used in the present invention are prepared in the hydrophobic polymer binder as described above or dispersed in the hydrophobic polymer binder after preparation. The hydrophobic polymer binder is a transparent synthetic polymer, examples of which include those described in U.S. Pat. Nos. 3,142,586, 3,193,386, 3,062,674, 3,220,844, 3,287,289 and 3,411,911. Examples of the effective polymers include a water-insoluble polymer composed of a monomer such as an alkyl acrylate, an alkyl methacrylate, acrylic acid, a sulfoalkyl acrylate or a sulfoalkyl methacrylate, etc., and a polymer having a cyclic sulfobetaine unit as described in Canadian Pat. No. 774,054. Examples of preferred polymers include polyvinyl butyral, polyacrylamide, cellulose acetate butyrate, cellulose acetate propionate, polymethyl methacrylate, polyvinyl pyrrolidone, polystyrene, ethyl cellulose, polyvinyl chloride, chlorinated rubber, polyisobutylene, a butadiene-styrene copolymer, a vinyl chloride-vinyl acetate copolymer, a vinyl chloride-vinyl acetate-maleic acid copolymer, polyvinyl alcohol, polyvinyl acetate, benzyl cellulose, acetyl cellulose, cellulose propionate and cellulose acetate phthalate, etc. Among these polymers, polyvinyl butyral, polyvinyl acetate, ethyl cellulose, polymethyl methacrylate and cellulose acetate butyrate are particularly preferred to use. If necessary, two or more of them may be used as a mixture. The amount of the hydrophobic polymer binder is in the range of from about 1/10 to 10 times and, preferably, from ¼ to 4 times by weight ratio based on the organic silver salt oxidizing agent.

The support used in the present invention should be able to endure the processing temperatures. Typical examples of ordinary supports include not only glass, paper, metal or analogues thereof, but also an acetyl cellulose film, a cellulose ester film, a polyvinyl acetal film, a polystyrene film, a polycarbonate film, a polyethylene terephthalate film, and a film related thereto or a plastic material. The polyesters described in U.S. Pat. Nos. 3,634,089 and 3,725,070 are preferably used. A polyethylene terephthalate film is particularly preferred.

A practical method for forming a color image by development in the present invention is a thermal diffusion transfer process of a mobile dye. Therefore, the heat-developable color photographic material which can be used is composed of a support having thereon a light-sensitive layer (I) containing at least a silver halide, an organic silver salt oxidizing agent, a reducing agent thereof, a dye releasing coupler and a polymer binder and an image receiving layer (II) capable of receiving a mobile dye formed in the layer (I).

The above-described light-sensitive layer (I) and the image receiving layer (II) may be provided on the same support. Alternatively, they may be provided on different supports. The image receiving layer (II) can be peeled apart from the light-sensitive layer (I). For example, after the heat-developable color photographic material is imagewise exposed to light, it is developed by heating uniformly and thereafter the image receiving layer is peeled apart.

In another practical method, after the heat-developable color photographic material is imagewise exposed to light, the image receiving layer (II) is superimposed on the light-sensitive layer and they are developed by uniform heating. Furthermore, after the heat-developable color photographic material is imagewise exposed to light and developed by heating uniformly, the image receiving layer (II) is superimposed on the light-sensitive layer and they are heated at a temperature lower than the developing temperature to diffuse a dye.

The image receiving layer (II) contains a dye mordant. In the present invention, various mordants can be used, and a useful mordant can be selected depending on the properties of the dye, the conditions for transfer, and other components contained in the photographic material, etc. Useful mordants are polymers containing an ammonium salt group which are described in U.S. Pat. No. 3,709,690. An example of a useful polymer containing an ammonium salt group is poly-(styrene-co-N,N,N-tri-n-hexyl-N-vinylbenzylammonium chloride) wherein the ratio of styrene and vinyl benzylammonium chloride is about 1:4 to about 4:1 and, preferably, 1:1. Typical diffusion transfer photographic material is obtained by mixing a polymer containing an ammonium salt group with gelatin and applying the mixture to a transparent support. The transfer of dyes from the heat-developable color light-sensitive layer to the image receiving layer can be carried out using a transfer solvent. Examples of useful transfer solvents include solvents having a low boiling point such as methanol, ethyl acetate, diisobutyl kentone, N,N-dimethyl formamide, etc., or a solvent having a high boiling point such as tri-n-cresyl phosphate, tri-n-nonyl phosphate, di-n-butyl phthalate. When using a solvent having a high boiling point, it can be added to the mordant layer by emulsifying it in gelatin using a suitable emulsifier. In another practical method, a layer of titanium dioxide dispersed in gelatin can be provided on the mordant layer on a transparent support. The titanium dioxide layer forms a white apaque layer, by which a reflective color image is obtained when the transferred color image is observed through the transparent support.

In the present invention, it is not necessary to further incorporate a substance or a dye for preventing irradiation or halation in the photographic material, since the dye releasing coupler is colored. However, it is possible to add a filter dye or a light absorbent material as described in Japanese Patent Publication No. 3692/73, U.S. Pat. Nos. 3,253,921, 2,527,583, and 2,956,879, etc., in order to further improve sharpness. Preferably, these dyes have a thermally bleaching property. For example, dyes as described in U.S. Pat. Nos. 3,769,019, 3,745,009 and 3,615,432 are preferred.

The photographic material according to the present invention may contain various additives known for the heat-developable photographic material and may have an antistatic layer, an electrically conductive layer, a protective layer, an intermediate layer, an antihalation layer and a strippable layer, etc., in addition to the light-sensitive layer. As the additives, those described in *Research Disclosure,* Vol. 170, No. 17029, June 1978, for example, a plasticizer, a dye for improving sharpness, an antihalation dye, a sensitizing dye, a matting agent, a surface active agent, a fluorescent whitening agent, a fading preventing agent, etc., may be used.

The protective layer, the intermediate layer, the subbing layer, the back layer and other layers can be produced by preparing each coating solution and applying in order to the support by various coating methods. Examples of such methods include dip coating, air-knife coating, curtain coating, and hopper coating as described in U.S. Pat. No. 2,681,294 and drying. The heat-developable light-sensitive layer of the present invention can be prepared in the same manner in order to prepare a photographic material.

If desired, two or more layers may be applied to at the same time by the method described in U.S. Pat. No. 2,761,791 and British Pat. No. 837,095.

For the heat-developable photographic material of the present invention, various means for exposing to light can be used. A latent image is obtained by image-wise exposure to radiant rays including visible rays. Generally, a light source used for conventional color prints can be used, examples of which include a tungsten lamp, a mercury lamp, a halogen lamp such as an iodine lamp, etc., a xenon lamp, a laser light source, a CRT light source, a fluorescent tube and a light-emitting diode.

As the original, not only a line drawing but a photograph having gradation may be used. Further, photographs having gradation may be used. It is also possible to take a photograph of a portrait or landscape by means of a camera. Printing from the original may be carried out by contact printing by superimposing the original on the photographic material or may be carried out by reflection printing or enlargement printing.

Further, it is possible to carry out the printing of an image photographed by a videocamera or image information sent from a television broadcasting station by displaying directly on CRT or FOT and forcusing the resulting image on the heat-developable photographic material by contacting therewith or by means of a lens.

Recently, LED (light-emitting diode) which has been greatly improved is utilized as an exposure means or display means for various apparatus and devices. It is difficult to produce LED which effectively emits blue light. In this case, in order to reproduce the color image, three kinds of LED consisting of those emitting each green light, red light and infrared light are used, and the light-sensitive layers to be sensitized to these lights are produced so as to release a yellow dye, a magenta dye and a cyan dye, respectively. Namely, the photographic material has produced such a construction that the green-sensitive part (layer) contains a yellow dye releasing coupler, the red-sensitive part (layer) contains a magenta dye releasing coupler and the infra-red-sensitive part (layer) contains a cyan dye releasing coupler. Other combinations can be utilized, if desired.

Besides the above-described methods for contact exposure or projection of the original, there can be used a method of exposure wherein the original illuminated by a light source is stored in a memory of a leading computer by means of a light-receiving element such as a phototube or CCD, etc., the information is, if desired, subjected to processing, the so-called image treatment, and the resulting image information is produced on CRT to utilize as an imagelike light source or three kinds of LED are emitted according to the processed information.

After the heat-developable color photographic material is exposed to light, the latent image thus-obtained can be developed by heating the whole material at a suitably elevated temperature, for example, from about 80° C. to about 250° C. for from about 0.5 second to about 300 seconds. Any higher or lower temperature can be utilized by prolonging or shortening the heating time, if it is within the above-described range. Particularly, a temperature range from about 110° C. to about 160° C. is useful. As a heating means, a simple heat plate, an iron, a heat roller or analogues thereof may be used.

The synthesis method of the dye releasing coupler is described below. The dye releasing coupler according to the present invention is represented by the following general formula:

B—C—L—D wherein C represents a coupler capable of bonding to an oxidized product of a reducing agent; B represents a ballast group (diffusion resistant group); L represents a connecting group between C and D; and D represents a dye portion for forming an image. The dye releasing coupler represented by the above-described general formula can be generally synthesized according to the following two schemes:

Scheme 1:

$$C \xrightarrow{L} C-L \xrightarrow{B} B-C-L \xrightarrow{D} B-C-L-D$$

Scheme 2:

$$C \xrightarrow{L} C-L \xrightarrow{D} C-L-D \xrightarrow{B} B-C-L-D$$

The decision on which method to be used depends on the kind of the coupler C used. For example, in the case of a phenol type coupler and a naphthol type coupler both of which are particularly important, the former can be synthesized according to the Scheme 2 and the latter can be synthesized according to the Scheme 1. Further, the method for introducing the ballast group B is also different depending on the kind of the coupler C. For example, the introduction by acylation of an amino group at the 2-position in a phenol type coupler and the introduction by amidation of a carboxyl group (or an ester group) at the 2-position in a naphthol type coupler are very general procedures. On the other hand, the introduction of the dye portion is usually carried out by a condensation reaction between a terminal group of the connecting group L and a terminal group of the dye portion D in the Scheme 1. However, in Scheme 2 this is carried out by an azo coupling method. Specific examples for the synthesis of the dye releasing couplers are set forth below, but the present invention is not to be construed as being limited thereto.

SYNTHESIS EXAMPLE 1

Synthesis of Dye Releasing Coupler [1]

Step [1-a]: Synthesis of Dye Portion (4-[N-Ethyl-N-(2-p-toluenesulfonyloxyethyl)sulfamoyl]-2-nitrodiphenylamine; Compound [1-a])

15.8 g (0.05 mol) of sodium 2-nitrodiphenylamine-4-sulfonate was added to a mixture of 80 ml of acetonitrile and 40 ml of dimethylacetamide and to which was added dropwise 30 ml of phosphorus oxychloride at a temperature between 20° C. and 30° C. After stirring at room temperature for 2 hours, the reaction liquid was poured into ice water and the resulting yellow precipitate was collected by filtration to obtain the sulfonic acid chloride. Yield: 14.8 g.

Then the sulfonic acid chloride was added little by little to a mixture of 13.4 g (0.15 mol) of N-ethylethanolamine and 40 ml of acetonitrile under cooling with ice. After stirring at room temperature for 1 hour, the reaction solution was poured into cold diluted hydrochloric acid and the resulting yellow precipitate was collected by filtration. Yield: 15.4 g. (The product was recrystallizable from diluted ethanol aqueous solution.)

11 g of the thus-obtained compound was dissolved in 30 ml of pyridine and to the solution was added little by little 11.4 g of p-toluenesulfonyl chloride at a temperature range between 15° C. and 20° C. After stirring at room temperature for 1 hour, the reaction solution was poured into cold diluted hydrochloric acid, the mixture was stirred for 1 hour and then the resulting precipitate of Compound [1-a] was collected by filtration. Yield: 13.4 g.

Step [1-b]: Synthesis of Dye Releasing Coupler [1]

A mixture composed of 2.98 g (0.02 mol) of 5-hydroxy-2-methylbenzoxazole, 10.4 g (0.02 mol) of Compound [1-a], 2.76 of anhydrous potassium carbonate and 30 ml of dimethylacetamide was heated on a water bath for 3 hours with stirring. After allowing to cool, the reaction solution was poured into diluted hydrochloric acid and the resulting precipitate was collected by filtration. The compound was then added to a mixture composed of 20 ml of hydrochloric acid and 30 ml of ethanol and the mixture was refluxed by heating on a water bath for 3 hours. After allowing to cool, the crystals thus-deposited were collected by filtration and dried. Yield: 6.1 g.

5.09 g of the crystals thus-obtained were added to a mixture composed of 2 ml of pyridine and 30 ml of acetonitrile and dissolved by heating. To the solution was added 1.63 g of phthalic anhydride and the mixture was refluxed by heating for 1 hour. After allowing to cool, the crystals thus-deposited were collected by filtration to obtain the yellow crystals of Dye Releasing Coupler [1].

| Elemental Analysis for $C_{30}H_{28}N_4O_9S$ | C | H | N |
|---|---|---|---|
| Calculated (%): | 58.06 | 4.55 | 9.03 |
| Found (%): | 58.94 | 4.31 | 8.74 |

SYNTHESIS EXAMPLE 2

Synthesis of Dye Releasing Coupler [2]

Step [2-a]: Synthesis of Dye Portion (N-Ethyl-N-(2-p-toluenesulfonyloxyethyl)-3-methyl-4-(5,6-dichloro-2-benzothiazolylazo)aniline; Compound [2-a])

4.38 g (0.02 mol) of 5,6-dichloro-2-aminobenzothiazole was diazotized at a temperature range between 25° C. and 30° C. using nitrosyl sulfuric acid prepared from 1.54 g of sodium nitrile and 10 ml of sulfuric acid. The excess nitrous acid was decomposed with urea and then the diazotized solution was added to a mixture composed of 3.58 g (0.02 mol) of N-ethyl-N-hydroxyethyl-m-toluidine, 42 g of anhydrous sodium acetate, 150 ml of water and 50 ml of acetonitrile at a temperature range between 0° C. to 5° C. After stirring at a temperature range between 5° C. and 10° C. for 30 minutes, 100 ml of water was added to the reaction mixture and the dark red precipitate thus-deposited was collected by filtration, washed thoroughly with water and dried. Yield: 7.7 g.

Then 6.14 g of the compound thus obtained was dissolved in 25 ml of pyridine and to the solution was added little by little each 3.6 g of p-toluenesulfonyl chloride three times with an interval of 30 minutes (10.8 g in total) at a temperature between 15° C. and 20° C. After stirring at room temperature for 1 hour, the reaction solution was poured into excess cold diluted hydrochloric acid, the mixture was neutralized with sodium acetate and the precipitate of Compound [2-a] was collected by filtration. Yield: 8.1 g.

Step [2-b]: Synthesis of Dye Releasing Coupler [2]

A mixture composed of 1.49 g (0.01 mol) of 5-hydroxy-2-methylbenzoxazole, 5.63 g (0.01 mol) of Compound [2-a], 1.38 g of anhydrous potassium carbonate and 20 ml of dimethylacetamide was heated on a water bath for 3 hours with stirring. After allowing to cool, the reaction solution was poured into diluted hydrochloric acid and the resulting precipitate was collected by filtration. The compound thus-obtained was treated with hydrochloric acid and reacted with phthalic anhydride in the presence of pyridine under the same conditions as described for Step [1-b] in Synthesis Example 1 to obtain Dye Releasing Coupler [2].

| Elemental Analysis for $C_{32}H_{27}N_5O_5SCl_2$ | C | H | N |
|---|---|---|---|
| Calculated (%): | 57.83 | 4.10 | 10.54 |
| Found (%): | 57.28 | 3.82 | 10.36 |

SYNTHESIS EXAMPLE 3

Synthesis of Dye Releasing Coupler [3]

A mixture composed of 3.62 g (0.02 mol) of 2,6-dimethyl-5-hydroxybenzoxazole, 10.4 g (0.02 mol) of Compound [1-a], 2.76 g of anhydrous potassium carbonate and 30 ml of dimethylacetamide was heated on a water bath for 5 hours with stirring. After allowing to cool, the reaction solution was poured into diluted hydrochloric acid and the resulting precipitate was collected by filtration (which was recrystallizable from methanol). The compound thus-obtained was treated with hydrochloric acid and reacted with phthalic anhydride in the presence of pyridine under the same conditions as described for Step [1-b] in Synthesis Example 1 to obtain Dye Releasing Coupler [3].

| Elemental Analysis for $C_{31}H_{30}N_4O_9S$ | C | H | N |
|---|---|---|---|
| Calculated (%): | 58.68 | 4.77 | 8.83 |
| Found (%): | 57.98 | 4.66 | 8.57 |

SYNTHESIS EXAMPLE 4

Synthesis of Dye Releasing Coupler [4]

A mixture composed of 3.26 g (0.02 mol) of 2,6-dimethyl-5-hydroxybenzoxazole, 11.3 g (0.02 mol) of Compound [2-a], 2.76 g of anhydrous potassium carbonate and 40 ml of dimethylacetamide was heated on a water bath for 5 hours with stirring. After allowing to cool, the reaction solution was poured into diluted hydrochloric acid and the resulting dark red precipitate was collected by filtration and recrystallized from ethanol. Yield: 7.4 g.

The compound thus-obtained was treated with hydrochloric acid and reacted with phthalic anhydride in the presence of pyridine under the same conditions as described for Step [1-b] in Synthesis Example 1 to obtain Dye Releasing Coupler [4].

| Elemental Analysis for $C_{33}H_{29}N_5O_5SCl_2$ | C | H | N |
|---|---|---|---|
| Calculated (%): | 58.41 | 4.31 | 10.32 |
| Found (%): | 59.18 | 4.17 | 10.12 |

SYNTHESIS EXAMPLE 5

Synthesis of Dye Releasing Coupler [5]

56 g (0.2 mol) of phenyl 1,4-dihydroxy-2-naphthoate and 41.8 g (0.2 mol) of dimethyl 5-aminoisophthalate was dissolved in 100 ml of dimethylformamide by heating and heated at 150° C. for 6 hours under a nitrogen atmosphere. 100 ml of water and 100 ml of methanol were added while the mixture was still hot and the mixture was allowed to cool and the precipitate thus-deposited was collected by filtration to obtain Compound [5-a]. Yield: 68 g.

A mixture composed of 39.5 g (0.1 mol) of Compound [5-a], 25 g of ethylene bromohydrin, 19 g of p-toluenesulfonic acid and 600 ml of toluene was refluxed by heating for 6 hours and the resulting water was removed by azeotropic distillation. After allowing to cool, toluene was distilled from the reaction solution under reduced pressure to concentrate and the resulting crystals were collected by filtration to obtain Compound [5-b]. Yield: 41 g.

A mixture composed of 25.1 g (0.05 mol) of Compound [5-b], 12.5 g of N-ethyl-3-acetylaminoaniline, 10.7 g of 2,6-lutidine and 60 ml of dimethylacetamide was heated at a temperature range between 120° C. and 130° C. for 12 hours. After allowing to cool, the reaction solution was poured into cold diluted hydrochloric acid, salted out with a saturated aqueous sodium chloride solution and the resulting precipitate was collected by filtration. The precipitate thus-obtained was added to 200 ml of a 10% aqueous sodium hydroxide solution and the mixture was stirred at a temperature range between 45° C. and 50° C. for 2 hours. Under cooling with ice the mixture was neutralized with diluted hydrochloric acid and the resulting crystals were collected by filtration to obtain Compound [5-c] (which was recrystallizable from methyl cellosolve). Yield: 18.5 g.

3.78 g (0.02 mol) of 3,5-dinitro-2-aminothiophene was diazotized at a temperature range between 20° C. and 25° C. using nitrosyl sulfuric acid prepared from 1.52 g of sodium nitrite and 10 ml of sulfuric acid. The excess nitrous acid was decomposed with urea and then the diazotized solution was added little by little to a mixture composed of 11.4 g (0.02 mol) of Compound [5-c], 2 g of sodium hydroxide, 35 g of sodium acetate, 50 ml of acetonitrile and 200 ml of water at a temperature range between 5° C. and 10° C. After stirring at the same temperature range for 30 minutes, 200 ml of water was added to the mixture and the resulting dark blue precipitate was collected by filtration and washed with water. The crude product was recrystallized from a solvent mixture of dimethylformamide and ethanol to obtain the green-blue crystals of Dye Releasing Coupler [5].

| Elemental Analysis for $C_{35}H_{29}N_7O_{12}S$ | C | H | N |
|---|---|---|---|
| Calculated (%): | 54.47 | 3.79 | 12.71 |
| Found (%): | 55.10 | 3.99 | 12.35 |

The present invention will be explained in greater detail with reference to the following examples, but the present invention should not be construed as being limited thereto.

EXAMPLE 1

A silver benzotriazole emulsion containing light-sensitive silver bromide was prepared in the following manner.

| | | |
|---|---|---|
| (A) | Benzotriazole | 12 g |
| | Isopropyl alcohol | 200 ml |
| (B) | $AgNO_3$ | 17 g |
| | $H_2O$ | 50 ml |
| (C) | LiBr | 2.1 g |
| | Ethanol | 20 ml |

Solution B was added to Solution A with stirring at 40° C. Solution A became turbid and silver salts of benzotriazole were formed.

To the resulting solution, Solution C was added, by which silver was supplied from the silver benzotriazole to convert a part of silver benzotriazole into silver bromide.

The resulting powdery crystals were collected by filtration and they were added to a polymer solution prepared by dissolving 20 g of polyvinyl butyral in 200 ml of isopropyl alcohol, followed by dispersing for 30 minutes by a homogenizer.

To 10 g of the above-described silver benzotriazole emulsion containing light-sensitive silver bromide was added a solution prepared by dissolving 0.39 g of Dye Releasing Coupler [5] having the following formula:

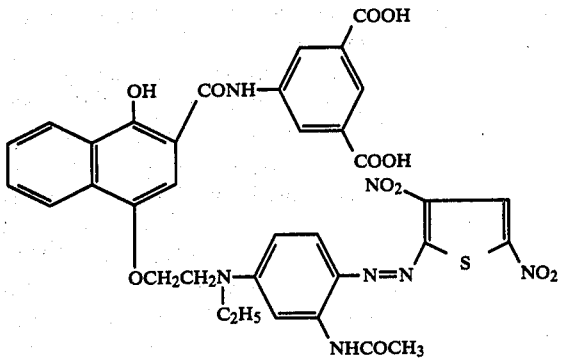

0.18 g of 2,6-dichloro-4-aminophenol and 0.22 g of guanidine trichloroacetate in a mixture of 4 ml of ethyl alcohol, 3 ml of ethyl acetate and 3 ml of N,N-dimethylformamide and stirred. The resulting mixture was applied to a polyethylene terephthalate film at a wet film thickness of 100 μm. After the resulting photographic material was dried, it was exposed at 2,000 luxes for 100 seconds using a tungsten lamp. This imagewise exposed sample was superimposed with an image receiving sheet containing a mordant wetted with tributyl phosphate and uniformly heated for 30 seconds on a heat block heated to 160° C.

The image receiving sheet used comprised a transparent polyethylene terephthalate film, a dye mordant layer on the film and a titanium dioxide layer as a top layer. The mordant was the polymer containing quaternary ammonium groups which is a copolymer of styrene and N,N,N-tri-n-hexyl-N-vinylbenzylammonium chloride (1:1).

By carrying out the above described operation a cyan negative image was obtained on the image receiving sheet. When the density of the cyan negative image was measured by a Macbeth reflection densitometer (RD-219), the maximum reflection density to red light was 2.20 and the minimum density was 0.65.

EXAMPLE 2

In place of the silver benzotriazole emulsion containing light-sensitive silver bromide used in Example 1, a silver 3-amino-5-benzylthio-1,2,4-triazole emulsion containing light-sensitive silver iodide was prepared in the manner as described below.

20.6 g of 3-amino-5-benzylthio-1,2,4-triazole was dissolved in a mixture of 200 ml of isopropyl alcohol and 200 ml of butyl acetate. To the solution was added with stirring a solution prepared by dissolving 17 g of silver nitrate in 100 ml of water.

The resulting precipitate of 3-amino-5-benzylthio-1,2,4-triazole silver salt was collected by filtration and added to a polymer solution prepared by dissolving 20 g of polyvinyl butyral in 200 ml of isopropyl alcohol.

The resulting mixture was dispersed for 20 minutes at 8,000 rpm using a homogenizer. To the resulting dispersion, a solution prepared by dissolving 2.1 g of lithium iodide in 20 ml of ethanol was added to form silver iodide on a part of silver 3-amino-5-benzylthio-1,2,4-triazole.

A photographic material was prepared by the same procedure as described in Example 1 except that 10 g of the above-described emulsion was used, and the same operation as described in Example 1 was carried out. As a result, a cyan negative image was obtained on the image receiving sheet. When the density of the cyan negative image was measured by a Macbeth reflection densitometer (RD-219), the maximum reflection density to red light was 2.15 and the minimum density was 0.55.

EXAMPLE 3

In place of the silver benzotriazole emulsion containing light-sensitive silver bromide used in Example 1, a silver behenate emulsion containing light-sensitive silver bromide was used.

The silver behenate emulsion containing light-sensitive silver bromide was prepared in the following manner.

340 g of behenic acid was added to 5,000 ml of water and dissolved by heating to 85° C. with stirring. To the solution, an aqueous solution containing 20 g of sodium hydroxide dissolved in 500 ml of water was added at a rate of 100 ml per minute.

The solution was cooled to 30° C., and a solution prepared by dissolving 85 g of silver nitrate in 500 ml of water was added to the above-described solution at a rate of 100 ml per minute. The mixture was stirred at 30° C. for 90 minutes.

To the resulting solution, a solution prepared by dissolving 40 g of polyvinyl butyral in a mixture of 500 ml of butyl acetate and 500 ml of isopropyl alcohol was added, and the mixture was allowed to stand. Then, the liquid phase was removed, and the solid phase was subjected to centrifugal separation (at 3,000 rpm for 30 minutes).

To the solid phase, 40 ml of isopropyl alcohol was added. The mixture was stirred for 10 minutes, and thereafter it was mixed with a solution prepared by dissolving 270 g of polyvinyl butyral in 800 ml of isopropyl alcohol, and the mixture was dispersed at 8,000 rpm for 30 minutes by a homogenizer. While maintaining the resulting solution at 50° C., 160 ml of acetone containing 4.2% by weight of N-bromosuccinimide was added thereto and the mixture was reacted for 60 minutes, by which silver bromide was formed on a part of silver behenate.

A photographic material was prepared by the same procedure as described in Example 1, except that 10 g of the above-described silver behenate emulsion containing light-sensitive silver bromide, and the same operation as described in Example 1 was carried out. As the result, a cyan negative image was obtained on the image receiving sheet. When the density of the cyan negative image was measured by a Macbeth reflection densitometer (RD-219), the maximum reflection density to red light was 1.20 and the minimum density was 0.35.

EXAMPLE 4

The same procedure as described in Example 1 was carried out, except that 0.31 g of Dye Releasing Coupler [1] having the following formula:

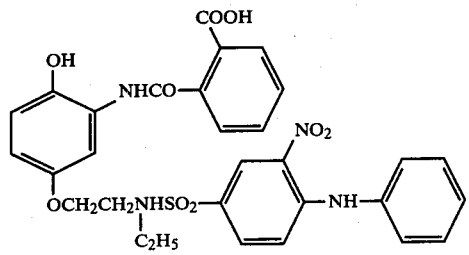

was used in place of Dye Releasing Coupler [5] in Example 1. As the result, a yellow negative image was obtained on the image receiving sheet. The maximum density was 1.30 as a reflection density to blue light and the minimum density was 0.40.

EXAMPLE 5

The same procedure as described in Example 1 was carried out, except that 0.33 g of Dye Releasing Coupler [2] having the following formula:

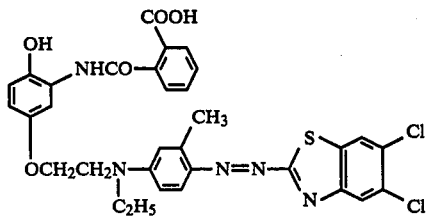

was used in place of Dye Releasing Coupler [5] in Example 1. As the result, a magenta negative image was obtained on the image receiving sheet. The maximum density was 2.05 as a reflection density to green light and the minimum density was 0.50. Further, the gradation of the sensitometric curve was a density difference of 1.40 to an exposure difference of 10 times in the straight line part.

EXAMPLE 6

To 10 g of silver benzotriazole emulsion containing the light-sensitive silver halide in Example 1, a solution prepared by dissolving 0.39 g of Dye Releasing Coupler [5], 0.18 g of 2,6-dichloro-4-amino phenol, 0.22 g of guanidine trichloroacetate and 1.0 g of polyethylene glycol having a molecular weight of 2,000 in a mixture of 4 ml of ethyl alcohol, 3 ml of ethyl acetate and 3 ml of N,N-dimethylformamide was added, and stirred. Thereafter, the above-described mixture was applied to a polyethylene terephthalate film at a wet film thickness of 100 μm and dried. The photographic material was exposed imagewise at 2,000 luxes for 100 seconds using a tungsten lamp. The exposed photographic material was superimposed with an image receiving sheet same as described in Example 1 and heated uniformly for about 30 seconds on a heat block heated to 160° C. As the result, a cyan negative image was obtained on the image receiving sheet. The maximum density was 2.00 as a reflection density to red light and the minimum density was 0.55.

EXAMPLE 7

A photographic material was prepared by the same procedure as described in Example 1. This photographic material was exposed imagewise to light for 100 seconds at 2,000 lux using a tungsten lamp, and thereafter it was uniformly heated for about 30 seconds on a heat block heated to 160° C. After the photographic material was cooled to room temperature, it was superimposed with an image receiving sheet same as described in Example 1 which had been wet with methanol to closely contact therewith at room temperature for 30 seconds. As a result, a negative cyan image was formed on the image receiving sheet. The maximum density was 1.90 as a reflection density to red light, and the minimum density was 0.60.

While the invention has been described in detail and with reference to specific embodiments thereof, it will be apparent to one skilled in the art that various changes and modifications can be made therein without departing from the spirit and scope thereof.

What is claimed is:

1. A diffusion transfer heat-developable color photographic material comprising a support having thereon a layer containing at least a light-sensitive silver halide, and the photographic material containing an organic silver salt oxidizing agent, a reducing agent, a hydrophobic binder and a dye releasing coupler which is immobile in a hydrophobic polymer binder wherein said dye releasing coupler has a diffusible dye portion attached thereto and wherein said coupler releases said diffusible dye upon heat development, wherein said dye does not have a carboxylic acid group or a sulfonic acid group.

2. A diffusion transfer heat-developable color photographic material comprising a support having thereon a layer containing at least a light-sensitive silver halide, and the photographic material containing an organic silver salt oxidizing agent, a reducing agent, a hydrophobic binder and a dye releasing coupler which is immobile in a hydrophobic polymer binder and which releases a diffusible dye upon heat development, wherein the dye does not have a carboxylic acid group or a sulfonic acid group, wherein the dye releasing coupler which releases the diffusible dye is represented by the following general formula:

C—L—D wherein C represents a coupler capable of bonding to an oxidized product which is formed by a reaction between a reducing agent and an organic silver salt oxidizing agent; D represents a dye portion for forming an image; and L represents a connection group between C and D and the bond between C and L is cleaved upon the reaction of C with the oxidized product of the reducing agent.

3. A diffusion transfer heat-developable color photographic material as claimed in claim 2, wherein the coupler represented by C includes an active methylene residue, an active methine residue, a phenol residue or a naphthol residue.

4. A diffusion transfer heat-developable color photographic material as claimed in claim 3, wherein the coupler represented by C is represented by the following general formula (I), (II), (III), (IV), (V), (VI) or (VII):

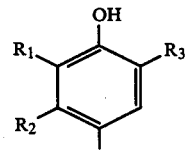

(I)

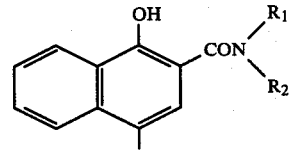

(II)

-continued (III)

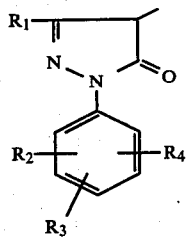

(IV)

$R_1COCHCOR_2$
|

(V)

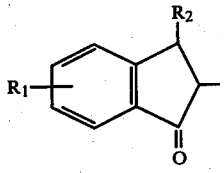

(VI)

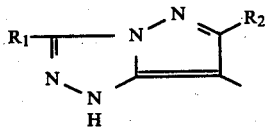

(VII)

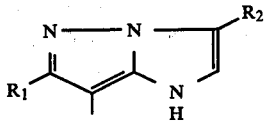

wherein $R_1$, $R_2$, $R_3$ and $R_4$ which may be the same or different each represents a hydrogen atom or a substituent selected from the group consisting of an alkyl group, a cycloalkyl group, an aryl group, an alkoxy group, an aryloxy group, an aralkyl group, an acyl group, an acylamino group, an alkoxyalkyl group, an aryloxyalkyl group, an N-substituted carbamoyl group, an alkylamino group, an arylamino group, a halogen atom, an acyloxy group, an acyloxyalkyl group and a cyano group, and these substituents may be further substituted with a hydroxyl group, a carboxyl group, a sulfo group, a cyano group, a nitro group, a sulfamoyl group, an N-substituted sulfamoyl group, a carbamoyl group, an N-substituted carbamoyl group, an acylamino group, an alkylsulfonylamino group, an arylsulfonylamino group, an alkyl group, an aryl group, an alkoxy group, an aryloxy group, an aralkyl group or an acyl group.

5. A diffusion transfer heat-developable color photographic material as claimed in claim 3, wherein the coupler represented by C is immobilized in a hydrophobic polymer binder.

6. A diffusion transfer heat-developable color photographic material as claimed in claim 5, wherein the coupler represented by C has a hydrophilic group selected from a sulfo group or a salt thereof, a carboxylic acid group or a salt thereof, a phosphoric acid group or a salt thereof, a carbonamido group, a sulfonamido group and a hydroxy group.

7. A diffusion transfer heat-developable color photographic material as claimed in claim 2, wherein the connecting group represented by L is a divalent group connecting between the coupler C and the dye portion D with a covalent bond.

8. A diffusion transfer heat-developable color photographic material as claimed in claim 2, wherein the connecting group represented by L is represented by the following general formula (VIII):

$$-A-X-B- \qquad \text{(VIII)}$$

wherein A and B, which may be the same or different, each represents an oxygen atom, a sulfur atom, a CO group, an SO group, an $SO_2$ group or an NR group where R is a hydrogen atom or an alkyl group; and X represents an organic group having not more than 12 carbon atoms as a total carbon atom including A and B.

9. A diffusion transfer heat-developable color photographic material as claimed in claim 7, wherein the divalent group is selected from the group represented by the following general formulae:

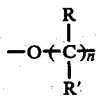

n = 0–3

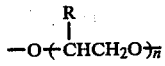

n = 1–2

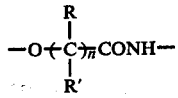

n = 0–3

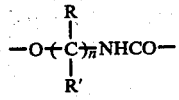

n = 1–3

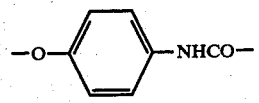

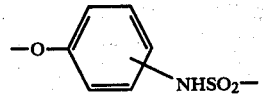

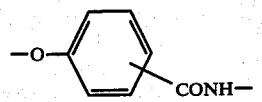

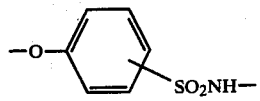

$-NHCONH-$

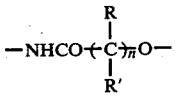

n = 0–3

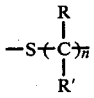

n = 0–3

-continued

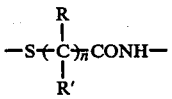

n = 1-3

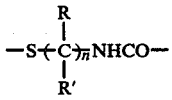

n = 1-3

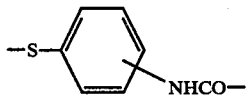

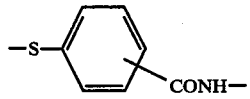

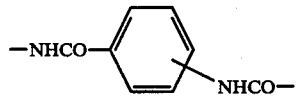

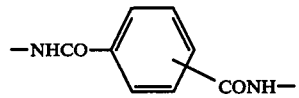

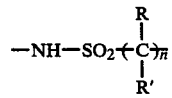

n = 0-3

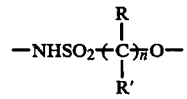

n = 1-4

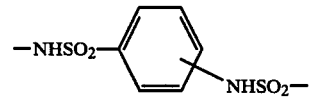

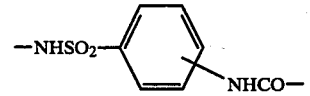

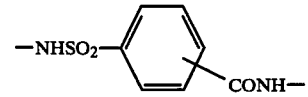

and

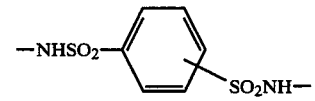

wherein R and R', which may be the same or different, each represents a hydrogen atom, a methyl group or an ethyl group, and the benzene ring may further be substituted with an alkyl group, an alkoxy group or a halogen atom.

10. A diffusion transfer heat-developable color photographic material as claimed in claim 7, wherein the divalent group is an O-releasing type group or an S-releasing type group and each group contains a total number of the carbon atoms of not more than 12.

11. A diffusion transfer heat-developable color photographic material as claimed in claim 2, wherein the dye portion represented by D includes an azo dye, an azomethine dye, an anthraquinone dye, a naphthoquinone dye, a nitro dye, a styryl dye, a quinophthalone dye, a triphenylmethane dye or a phthalocyanine dye.

12. A diffusion transfer heat-developable color photographic material as claimed in claim 11, wherein the dye included in the dye portion represented by D is represented by the following general formula:

Yellow:

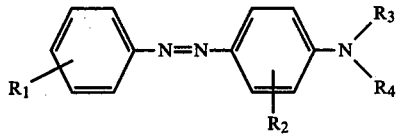

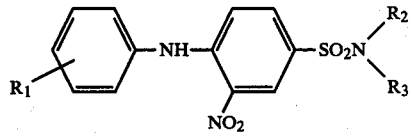

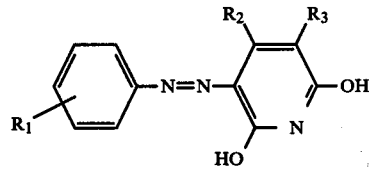

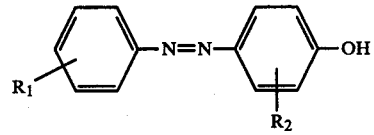

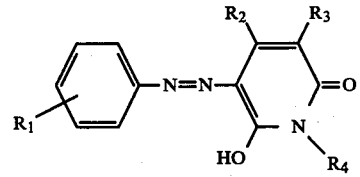

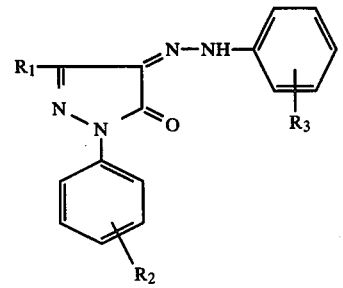

-continued
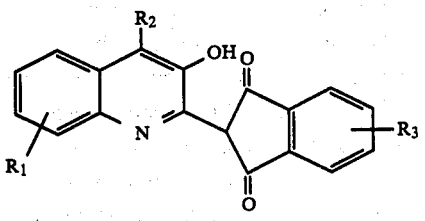
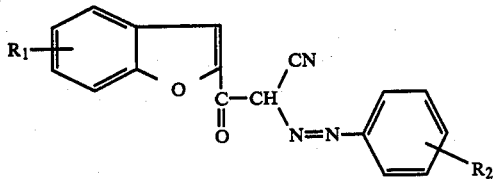
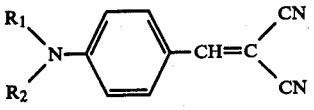
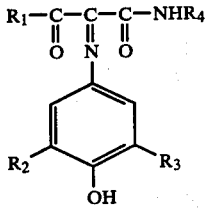
Magenta:
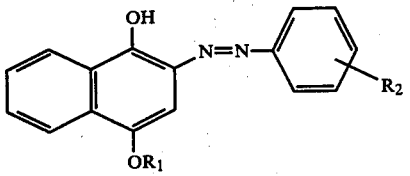
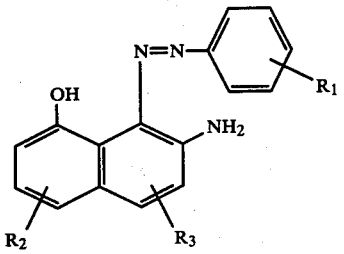
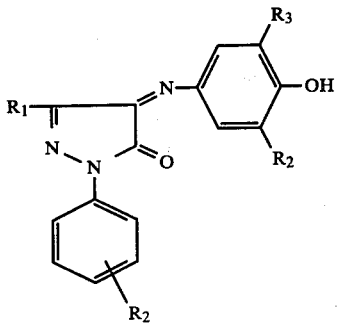
-continued
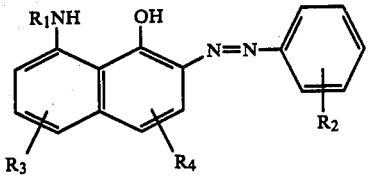
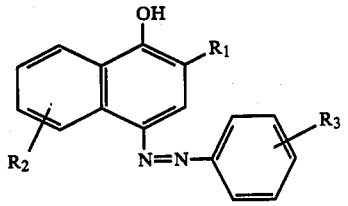
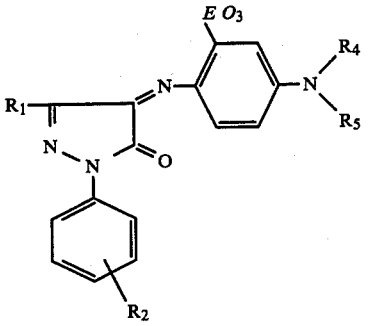
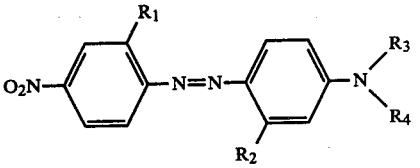
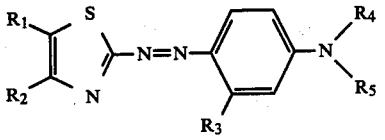
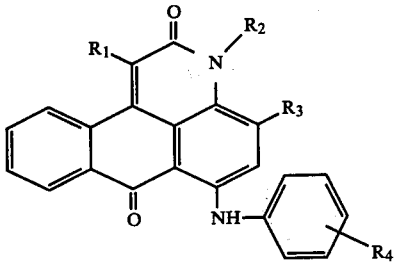
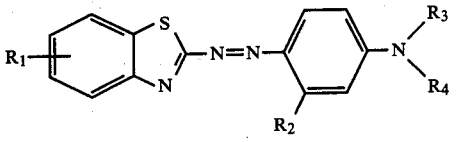

-continued
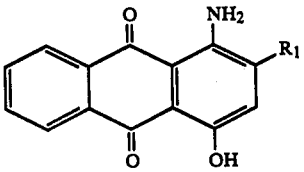
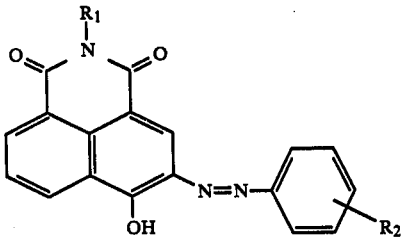
Cyan:
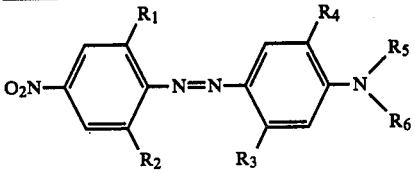
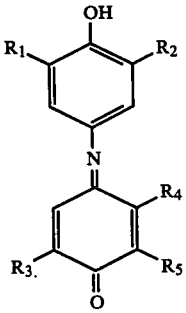
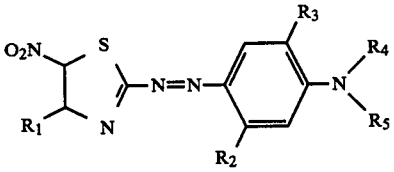
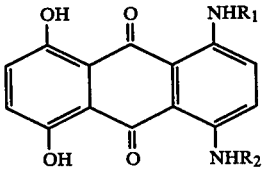
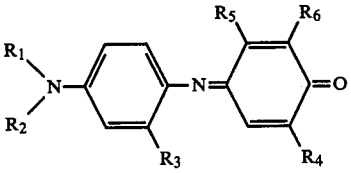
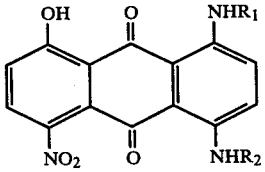
-continued
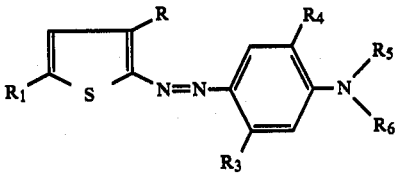
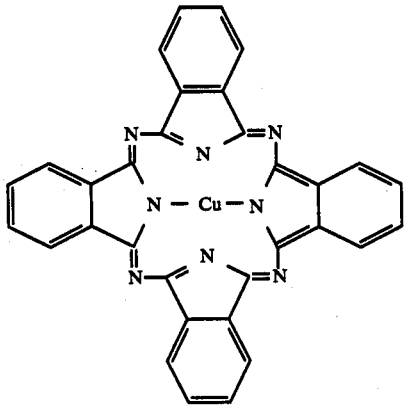
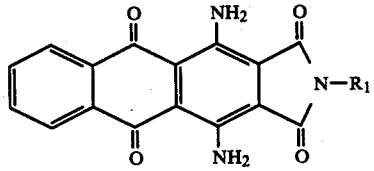
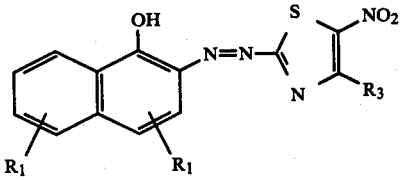
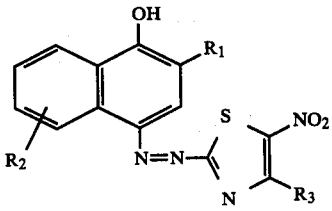
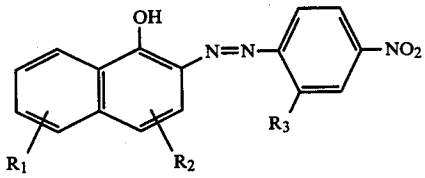

-continued

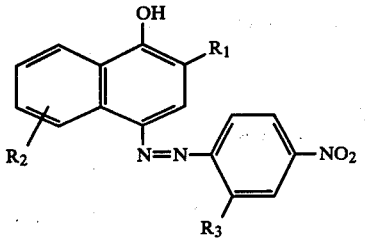

wherein $R_1$ to $R_6$, which may be the same or different, each represents a hydrogen atom or a substituent selected from the group consisting of an alkyl group, a cycloalkyl group, an aralkyl group, an alkoxy group, an aryloxy group, an aryl group, an acylamino group, an acyl group, a cyano group, a hydroxy group, an alkylsulfonylamino group, an arylsulfonylamino group, an alkylsulfonyl group, a hydroxyalkyl group, a cyanoalkyl group, an alkoxycarbonylalkyl group, an alkoxyalkyl group, an aryloxyalkyl group, a nitro group, a halogen, a sulfamoyl group, an N-substituted sulfamoyl group, a carbamoyl group, an N-substituted carbamoyl group, an acyloxyalkyl group, an amino group, a substituted amino group, an alkylthio group and an arylthio group.

13. A diffusion transfer heat-developable color photographic material as claimed in claim 2, wherein the dye portion represented by D does not contain a hydrophilic group selected from a carboxy group and a sulfo group and is oil-soluble.

14. A diffusion transfer heat-developable color photographic material as claimed in claim 1, wherein the light-sensitive halide is silver chloride, silver chlorobromide, silver chloroiodide, silver bromide, silver iodobromide, silver chloroiodobromide or silver iodide.

15. A diffusion transfer heat-developable color photographic material as claimed in claim 1, wherein the light-sensitive silver halide is present in a range from 0.005 mol to 5 mols per mol of the organic silver salt oxidizing agent.

16. A diffusion transfer heat-developable color photographic material as claimed in claim 1, wherein the organic silver salt oxidizing agent is a silver salt of an organic compound having a carboxy group, a silver salt of a compound containing a mercapto group or a thione group or a silver salt of a compound containing an imino group.

17. A diffusion transfer heat-developable color photographic material as claimed in claim 1, wherein the light-sensitive silver halide and the organic silver salt oxidizing agent are present in the same layer.

18. A diffusion transfer heat-developable color photographic material as claimed in claim 1, wherein the reducing agent is a color developing agent capable of forming an image upon oxidative coupling.

19. A diffusion transfer heat-developable color photographic material as claimed in claim 18, wherein the color developing agent is a p-phenylenediamine type color developing agent, an aminophenol compound, an aminonaphthol compound, an aminohydroxypyrazole compound, an aminopyrazoline compound or a hydrazone compound.

20. A diffusion transfer heat-developable color photographic material as claimed in claim 1, wherein the color photographic material further contains a base or a base releasing agent.

21. A diffusion transfer heat-developable color photographic material as claimed in claim 1, wherein the color photographic material further contains a thermal solvent.

22. A diffusion transfer heat-developable color photographic material as claimed in claim 1, wherein the hydrophobic binder is a thermoplastic polymer.

23. A diffusion transfer heat-developable color photographic material as claimed in claim 1, wherein the hydrophobic binder is polyvinyl butyral, polyvinyl acetate, ethyl cellulose, polymethyl methacrylate or cellulose acetate butyrate.

24. A diffusion transfer heat-developable color photographic material as claimed in claim 1, wherein the color photographic material further comprises an image receiving layer capable of receiving a diffusible dye formed as the result of heat development.

25. A diffusion transfer heat-developable color photographic material as claimed in claim 24, wherein the image receiving layer contains a mordant.

26. A diffusion transfer heat-developable color photographic material as claimed in claim 2, wherein the coupler represented by C includes a ballast group.

27. A diffusion transfer heat-developable color photographic material as claimed in claim 1, wherein the color photographic material further contains a silver salt stabilizing compound.

28. A diffusion transfer heat-developable color photographic material as claimed in claim 1, wherein the light-sensitive silver halide, the organic silver salt oxidizing agent, the reducing agent, the hydrophobic binder and the dye releasing coupler are present in the same layer.

29. A method of forming a color image which comprises imagewise exposing a diffusion transfer heat-developable color photographic material comprising a support having thereon a layer containing at least a light-sensitive silver halide, and the photographic material containing an organic silver salt oxidizing agent, a reducing agent, a hydrophobic binder and a dye releasing coupler which is immobile in a hydrophobic polymer binder wherein said dye releasing coupler has a diffusible dye portion attached thereto and wherein said coupler releases said diffusible dye upon heat development, wherein said dye does not have a carboxylic acid group or a sulfonic acid group; developing the exposed photographic material by heating uniformly to release a diffusible dye; and transferring the diffusible dye to an image receiving layer.

30. A method of forming a color image as claimed in claim 29, wherein the heating is carried out at a temperature ranging from 80° C. to 250° C.

* * * * *